US006719051B2

(12) United States Patent
Hailey, Jr. et al.

(10) Patent No.: US 6,719,051 B2
(45) Date of Patent: Apr. 13, 2004

(54) SAND CONTROL SCREEN ASSEMBLY AND TREATMENT METHOD USING THE SAME

(75) Inventors: Travis T. Hailey, Jr., Sugar Land, TX (US); Thomas O. Roane, Corinth, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 47 days.

(21) Appl. No.: 10/057,042

(22) Filed: Jan. 25, 2002

(65) Prior Publication Data

US 2003/0141060 A1 Jul. 31, 2003

(51) Int. Cl.[7] ..... E21B 43/04

(52) U.S. Cl. ..... 166/278; 166/276; 166/51; 166/236

(58) Field of Search ..... 166/280, 308, 166/276, 278, 51, 227, 228, 236

(56) References Cited

U.S. PATENT DOCUMENTS

| | | | | |
|---|---|---|---|---|
| 2,342,913 A | | 2/1944 | Williams et al. | |
| 2,344,909 A | | 3/1944 | Williams et al. | |
| 4,428,428 A | | 1/1984 | Smyrl et al. | |
| 4,627,488 A | | 12/1986 | Szarka | |
| 4,932,474 A | * | 6/1990 | Schroeder, Jr. et al. | 166/278 |
| 4,945,991 A | | 8/1990 | Jones | 166/278 |
| 5,082,052 A | | 1/1992 | Jones et al. | 166/51 |
| 5,113,935 A | | 5/1992 | Jones et al. | 166/51 |
| 5,161,613 A | | 11/1992 | Jones | 166/242 |
| 5,161,618 A | | 11/1992 | Jones et al. | 166/308 |
| 5,333,688 A | | 8/1994 | Jones et al. | 166/278 |
| 5,343,949 A | | 9/1994 | Ross et al. | 166/278 |
| 5,355,953 A | | 10/1994 | Shy et al. | |
| 5,355,956 A | | 10/1994 | Restarick | 166/296 |

(List continued on next page.)

FOREIGN PATENT DOCUMENTS

| | | | |
|---|---|---|---|
| EP | 1 132 571 | 9/2001 | E21B/43/267 |
| GB | 2371319 A | 1/2002 | |
| GB | 2 381 021 A | 4/2003 | |
| GB | 2 381 811 A | 5/2003 | |
| WO | WO 99/12630 | 3/1999 | B01D/29/15 |
| WO | WO 00/61913 | 10/2000 | E21B/43/04 |
| WO | WO 01/14691 | 3/2001 | E21B/43/08 |
| WO | WO 01/42620 A1 | 6/2001 | |
| WO | WO 01/44619 | 6/2001 | E21B/43/04 |
| WO | WO 01/49970 A1 | 7/2001 | |
| WO | WO 02/10554 | 2/2002 | E21B/43/26 |
| WO | WO 02/055842 A1 | 7/2002 | |
| WO | WO 02/057594 A1 | 7/2002 | |

OTHER PUBLICATIONS

"Quantum Zonal Isolation Tool," pp. 12–13 of Sand Face Competions Catalog.

"Absolute Isolation System (ASI) Components," Halliburton Energy Services, Inc., p. 5–28 of Downhole Sand Control Components.

(List continued on next page.)

*Primary Examiner*—William Neuder
(74) *Attorney, Agent, or Firm*—Lawrence R. Youst

(57) ABSTRACT

A sand control screen assembly (40) and method for treating multiple formations traversed by a wellbore (34) in a single trip are disclosed. The sand control screen assembly (40) includes a base pipe (56) with multiple openings (58) that allow fluid flow therethrough. A filter medium (62) is positioned about the exterior of the base pipe (56) to filter particulate matter out of the production fluids. One-way valves (70) are positioned within the openings (58) of the base pipe (56) to prevent fluid flow from the interior of the base pipe (56) to the exterior of the base pipe (56) during and following a treatment process. The one-way valves (70), however, are actuatable to allow fluid flow from the exterior of the base pipe (56) to the interior of the base pipe (56) to allow production of fluids from the formation (14).

84 Claims, 16 Drawing Sheets

U.S. PATENT DOCUMENTS

| | | | | |
|---|---|---|---|---|
| 5,390,966 | A | 2/1995 | Cox et al. | 285/137.1 |
| 5,419,394 | A | 5/1995 | Jones | 166/51 |
| 5,435,393 | A | 7/1995 | Brekke et al. | |
| 5,443,117 | A | 8/1995 | Ross | 166/51 |
| 5,476,143 | A | 12/1995 | Sparlin et al. | 166/233 |
| 5,515,915 | A | 5/1996 | Jones et al. | 166/51 |
| 5,588,487 | A | 12/1996 | Bryant | 166/51 |
| 5,636,691 | A | 6/1997 | Hendrickson et al. | 166/278 |
| 5,722,490 | A | 3/1998 | Ebinger | |
| 5,755,286 | A | 5/1998 | Ebinger | 166/281 |
| 5,842,516 | A | 12/1998 | Jones | 166/56 |
| 5,848,645 | A | 12/1998 | Jones | 166/280 |
| 5,865,251 | A | 2/1999 | Rebardi et al. | |
| 5,868,200 | A | 2/1999 | Bryant et al. | 166/51 |
| 5,890,533 | A | 4/1999 | Jones | 166/51 |
| 5,896,928 | A | 4/1999 | Coon | |
| 5,921,318 | A | 7/1999 | Ross | 166/250.17 |
| 5,934,376 | A | 8/1999 | Nguyen et al. | 166/278 |
| 5,988,285 | A | 11/1999 | Tucker et al. | 166/373 |
| 6,003,600 | A | 12/1999 | Nguyen et al. | 166/281 |
| 6,047,773 | A | 4/2000 | Zeltmann et al. | 166/281 |
| 6,059,032 | A | 5/2000 | Jones | 166/278 |
| 6,116,343 | A | 9/2000 | Van Petegem et al. | 166/297 |
| 6,125,933 | A | 10/2000 | Ross | 166/250.01 |
| 6,220,345 | B1 | 4/2001 | Jones et al. | 166/51 |
| 6,227,303 | B1 | 5/2001 | Jones | 166/378 |
| 6,230,803 | B1 | 5/2001 | Morton et al. | 166/278 |
| 6,302,208 | B1 | 10/2001 | Walker et al. | 166/278 |
| 6,343,651 | B1 | 2/2002 | Bixenman | 166/278 |
| 6,457,518 | B1 | 10/2002 | Castano-Mears et al. | |
| 6,478,091 | B1 | 11/2002 | Gano | |
| 6,488,082 | B2 | 12/2002 | Echols et al. | |
| 6,540,022 | B2 * | 4/2003 | Dusterhoft et al. | 166/278 |
| 2002/0092649 | A1 | 7/2002 | Bixenman et al. | |
| 2002/0096329 | A1 | 7/2002 | Coon et al. | |
| 2002/0125008 | A1 | 9/2002 | Wetzel et al. | |
| 2002/0157837 | A1 | 10/2002 | Bode et al. | |
| 2002/0174981 | A1 | 11/2002 | Den Boer et al. | |
| 2003/0000875 | A1 | 1/2003 | Echols et al. | |
| 2003/0056947 | A1 | 3/2003 | Cameron | |
| 2003/0056948 | A1 | 3/2003 | Cameron | |
| 2003/0075324 | A1 * | 4/2003 | Dusterhoft et al. | 166/279 |
| 2003/0089496 | A1 | 5/2003 | Price-Smith et al. | |

OTHER PUBLICATIONS

"OSCA HPR–ISO System," 1 page, Technical Bulletin.
"OSCA The ISO System," 1 page, Technical Bulletin.
"Mechanical Fluid–Loss Control Systems Used During Sand Control Operations," H.L. Restarick of Otis Engineering Corp., 1992.
"Sand Control Screens," Halliburton Energy Services, 1994.
"Frac Pack Technology Still Evolving," Charles D. Ebinger of Ely & Associates Inc.; Oil & Gas Journal, Oct. 23, 1995.
"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.
"Caps$^{SM}$ Sand Control Service for Horizontal Completions Improves Gravel Pack Reliability and Increases Production Potential from Horizontal Completions," Halliburton Energy Services, Inc., Aug. 2000.
"CAPS$^{SM}$ Concentric Annular Packing Service for Sand Control," Halliburton Energy Services, Inc., Aug., 2000.
"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.
"OSCA Screen Communication System", 1 page, Technical Bulletin (1999).
"OSCA Pressure Actuated Circulating Valve", 1 page, Technical Bulletin (1999).

* cited by examiner

SAND CONTROL SCREEN ASSEMBLY AND TREATMENT METHOD USING THE SAME

TECHNICAL FIELD OF THE INVENTION

This invention relates, in general, to a sand control screen assembly positioned in a production interval of a wellbore and, in particular, to a sand control screen assembly having a seal member that prevents fluid flow from the interior to the exterior of the sand control screen assembly during the treatment of single or multiple formations during a single trip into the well.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids using surface processing equipment.

One method for preventing the production of such particulate material is to gravel pack the well adjacent to the unconsolidated or loosely consolidated production interval. In a typical gravel pack completion, a sand control screen is lowered into the wellbore on a work string to a position proximate the desired production interval. A fluid slurry including a liquid carrier and a relatively coarse particulate material, such as sand, gravel or proppants which are typically sized and graded and which are typically referred to herein as gravel, is then pumped down the work string and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

It has been found, however, that following a gravel packing operation, the fluid inside the sand control screen tends to leak off into the adjacent formation. This leak off not only results in the loss of the relatively expensive fluid into the formation, but may also result in damage to the gravel pack around the sand control screen and the formation by, for example, fracturing a formation when it is not desirable to fracture that formation. This fluid leak off is particularly problematic in cases where multiple production intervals within a single wellbore require gravel packing as the fluid remains in communication with the various formations for an extended period of time.

In other cases, it may be desirable to perform a formation fracturing and propping operation prior to or simultaneously with the gravel packing operation. Hydraulic fracturing of a hydrocarbon formation is sometimes necessary to increase the permeability of the formation adjacent the wellbore. According to conventional practice, a fracture fluid such as water, oil, oil/water emulsion, gelled water or gelled oil is pumped down the work string with sufficient volume and pressure to open multiple fractures in the production interval. The fracture fluid may carry a suitable propping agent, such as sand, gravel or proppants, which are typically referred to herein as proppants, into the fractures for the purpose of holding the fractures open following the fracturing operation.

The fracture fluid must be forced into the formation at a flow rate great enough to fracture the formation allowing the entrained proppant to enter the fractures and prop the formation structures apart, producing channels which will create highly conductive paths reaching out into the production interval, and thereby increasing the reservoir permeability in the fracture region. As such, the success of the fracture operation is dependent upon the ability to inject large volumes of hydraulic fracture fluid along the entire length of the formation at a high pressure and at a high flow rate.

It has been found, however, that it is difficult to fracture multiple formations traversed by the wellbore that are within a relatively close proximity of one another. This difficulty is the result of the complexity and length of the permanent downhole tools and the associated service tools used to perform the fracture operation. Accordingly, if formations are closer together than the axial length required for the permanent downhole tools and service tool, then certain of the formations cannot be isolated for individual treatment processes.

Therefore, a need has arisen for an apparatus and a treatment method that provide for the treatment of multiple formations that are located relatively close to one another by allowing the use of relatively simple and compact permanent downhole tools and service tools. A need has also arisen for an apparatus and a treatment method that allow for the gravel packing of one or more production intervals while preventing fluid loss into adjacent formations.

SUMMARY OF THE INVENTION

The present invention disclosed herein comprises a sand control screen assembly and method for treating multiple formations traversed by a wellbore in a single trip. The sand control screen of the present invention provides for the treatment of relatively closely spaced formations by allowing the use of relatively simple and compact permanent downhole tools and service tools. In addition, the sand control screen of the present invention prevents undesirable fluid loss from the interior thereof to an adjacent formation.

The sand control screen assembly of the present invention includes a base pipe with multiple openings designed to allow fluid flow therethrough. A filter medium is positioned about the exterior of the base pipe to filter particulate matter during hydrocarbon production. A seal member is positioned within the openings of the base pipe to selectively prevent fluid flow through the sand control screen assembly. The seal member may include plugs, a sleeve, one-way valves or the like to achieve this result. If the seal member uses one-way valves, the one-way valves may be positioned within the openings of the base pipe to prevent fluid flow from the interior of the base pipe to the exterior of the base pipe. The one-way valves are actuatable to allow fluid flow from the exterior of the base pipe to the interior of the base pipe to, for example, allow fluid returns to flow therethrough during a gravel packing operation or to allow production fluids to flow therethrough.

A variety of downhole treatment operations may be achieved using the sand control screen assembly of the present invention. For example, one treatment method involves locating a sand control screen assembly within a production interval of a wellbore, preventing fluid flow from the interior to the exterior of the sand control screen assembly with a seal member disposed within the base pipe that controls fluid flow through the openings of the base pipe and pumping a treatment fluid into the production interval. In this method, the treatment fluid may be a fracture fluid or a gravel packing fluid. Alternatively, the treatment fluid may be a series of treatment fluids.

For example, in a first phase of a treatment process, the treatment fluid may have a relatively low density and a relatively low viscosity and contain a relatively high concentration of solid agents therein. These solid agents may be used to form a sand plug within the interior of the sand control screen assembly. In a second phase of the treatment processes, the treatment fluid may have a relatively high density and a relatively high viscosity but contain little or no solid agents. This treatment composition is suitable for formation fracturing. In a third phase of the treatment process, the density and viscosity of treatment fluid may be reduced and the treatment fluid will again contain a relatively high concentration of solid agents therein. These solid agents are used to prop the formation fractures and pack the production interval between the sand control screen assembly and the wellbore.

In the downhole treatment operations of the present invention using the sand control screen assembly of the present invention, fluid flow is prevented from the interior to the exterior of the sand control screen assembly of the present invention. By preventing this fluid flow both during and following certain treatment operations, fluid loss is prevented, damage to the formation and the gravel pack is reduced and simpler, more compact service tools and permanent downhole tools may be utilized. In addition, use of such simpler, more compact service tools and permanent downhole tools makes the treatment operations of the present invention using the sand control screen assembly of the present invention particularly advantageous for treating multiple formations traversed by a wellbore on a single trip.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
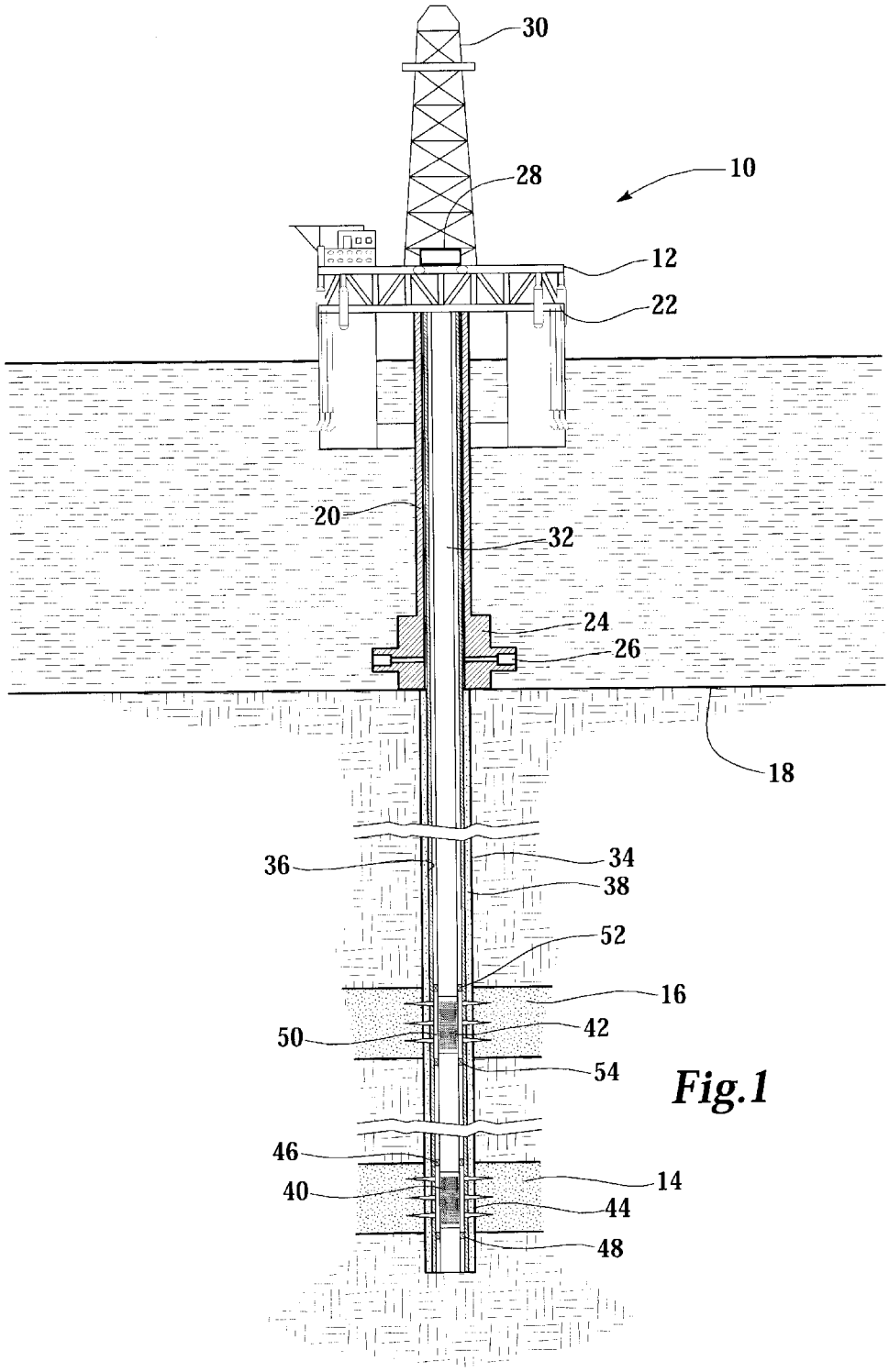
FIG. 1 is a schematic illustration of an offshore oil and gas platform operating a pair of sand control screen assemblies of the present invention.

Referring initially to FIG. 1, a pair of sand control screen assemblies used during the treatment of multiple intervals of a wellbore in a single trip and operating from an offshore oil and gas platform is schematically illustrated and generally designated 10. A semi-submersible platform 12 is centered over a pair of submerged oil and gas formations 14, 16 located below a sea floor 18. A subsea conduit 20 extends from a deck 22 of the platform 12 to a wellhead installation 24 including blowout preventers 26. Platform 12 has a hoisting apparatus 28 and a derrick 30 for raising and lowering pipe strings such as a work string 32.

A wellbore 34 extends through the various earth strata including formations 14, 16. A casing 36 is cemented within wellbore 34 by cement 38. Work string 32 includes various tools including a sand control screen 40 which is positioned within production interval 44 between packers 46, 48 and adjacent to formation 14 and sand control screen 42 which is positioned within production interval 50 between packers 52, 54 and adjacent to formation 16. Thereafter, a treatment fluid containing sand, gravel, proppants or the like is pumped down work string 32 such that formations 14, 16 may be sequentially treated.

Even though FIG. 1 depicts a vertical well, it should be noted by one skilled in the art that the sand control screen assemblies of the present invention are equally well-suited for use in deviated wells, inclined wells or horizontal wells. Also, even though FIG. 1 depicts an offshore operation, it should be noted by one skilled in the art that the sand control screen assemblies of the present invention are equally well-suited for use in onshore operations. Also, even though FIG. 1 depicts two formations, it should be understood by one skilled in the art that the treatment processes of the present invention are equally well-suited for use with any number of formations.

Figure 2:
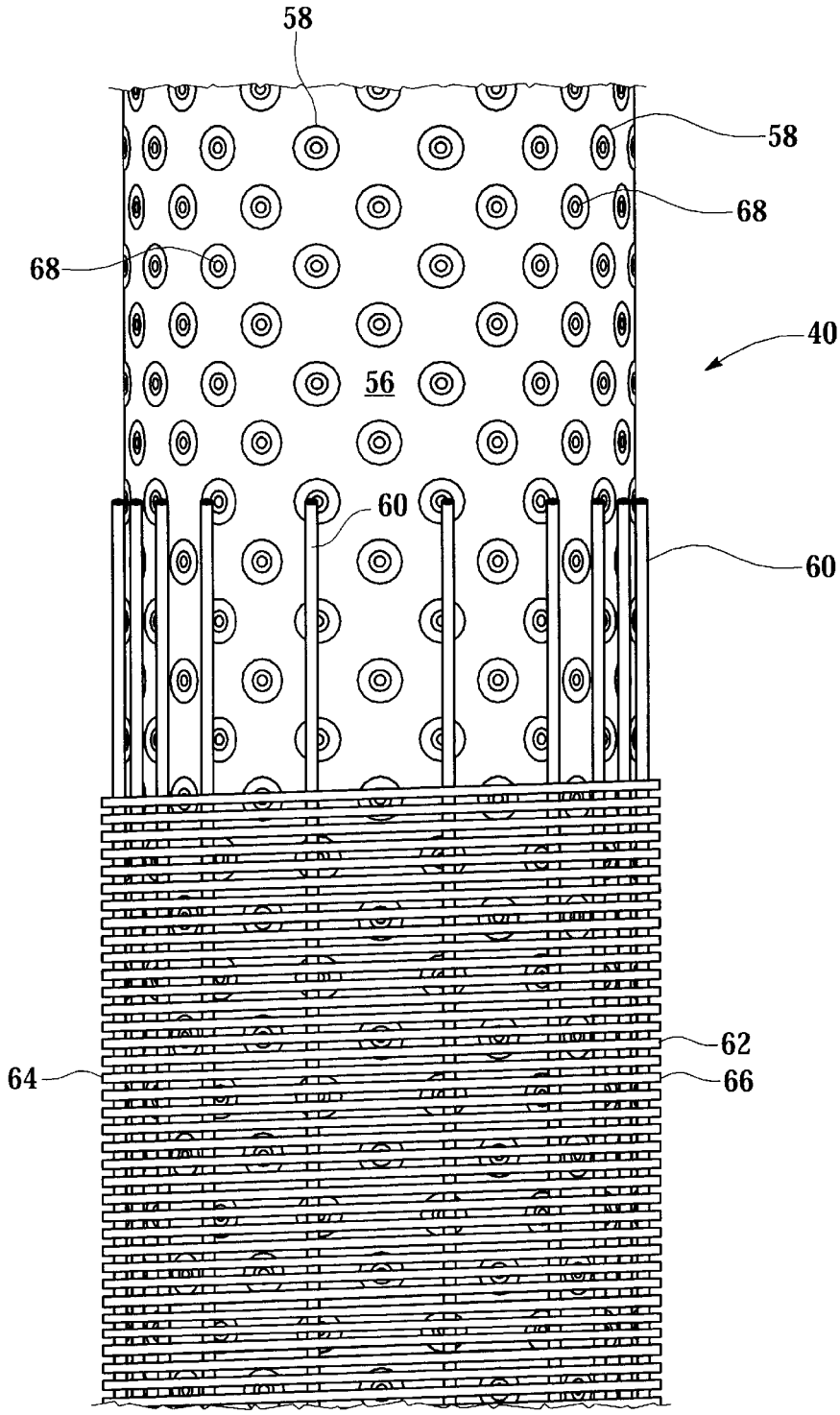
FIG. 2 is a partial cut away view of a sand control screen assembly of the present invention having a seal member disposed within a base pipe.
Figure 3:
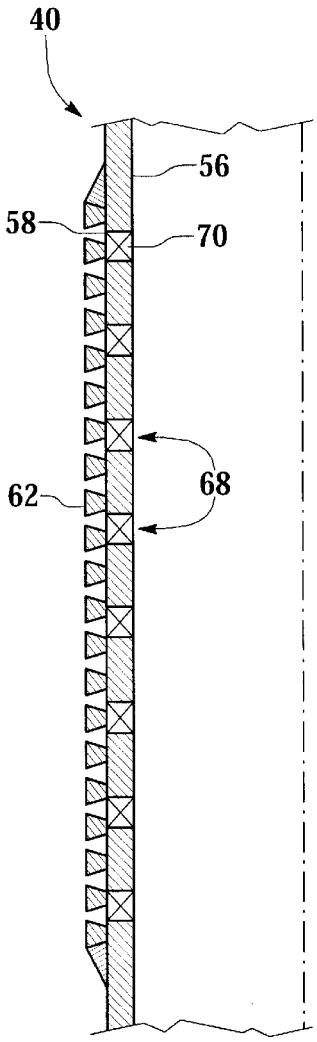
FIG. 3 is a cross sectional view of a sand control screen assembly of the present invention having a seal member comprising a plurality of one-way valves.

Referring now to FIG. 2 and FIG. 3, in conjunction, therein is depicted a more detailed illustration of a sand control screen assembly of the present invention, such as, for example, sand control screen assembly 40 of FIG. 1. Sand control screen assembly 40 includes a base pipe 56 that has a plurality of openings 58 which allow the flow of production fluids into sand control screen assembly 40. The exact number, size and shape of openings 58 are not critical to the present invention, so long as sufficient area is provided for fluid production and the integrity of base pipe 56 is maintained.

Spaced around base pipe 56 is a plurality of ribs 60. Ribs 60 are generally symmetrically distributed about the axis of base pipe 56. Ribs 60 are depicted as having a cylindrical cross section, however, it should be understood by one skilled in the art that ribs 60 may alternatively have a rectangular or triangular cross section or other suitable geometry. Additionally, it should be understood by one skilled in the art that the exact number of ribs 60 will be dependant upon the diameter of base pipe 56 as well as other design characteristics that are well known in the art.

Wrapped around the ribs 60 is a screen wire 62. Screen wire 62 forms a plurality of turns, such as turn 64 and turn 66. Between each of the turns is a gap through which formation fluids flow. The number of turns and the gap between the turns are determined based upon the characteristics of the formation from which fluid is being produced and the size of the gravel to be used during the gravel packing operation. Together, ribs 60 and screen wire 62 may form a sand control screen jacket which is attached to base pipe 56 by welding or other suitable techniques.

A one-way valve 70 is disposed within each opening 58 of base pipe 56 to prevent fluid flow from the interior to the exterior of the sand control screen assembly 40. One-way valves 70 may be referred to collectively as a seal member 68. Preferably, one-way valves 70 are flush mounted within openings 58 by threading, stamping or other suitable technique. Ball and seat type one-way valves have been found to be suitable, however, other types of one-way valves may also be used including poppet valves, sleeve valves and the like. One-way valves 70 prevent fluid flow from the interior to the exterior of sand control screen assembly 40 and are actuatable to allow fluid flow from the exterior to the interior of sand control screen assembly 40. Accordingly, when one-way valves 70 are used within base pipe 56 of sand control screen assembly 40 during production, production fluids are allowed to flow through sand control screen assembly 40 through one-way valves 70.

Figure 4:
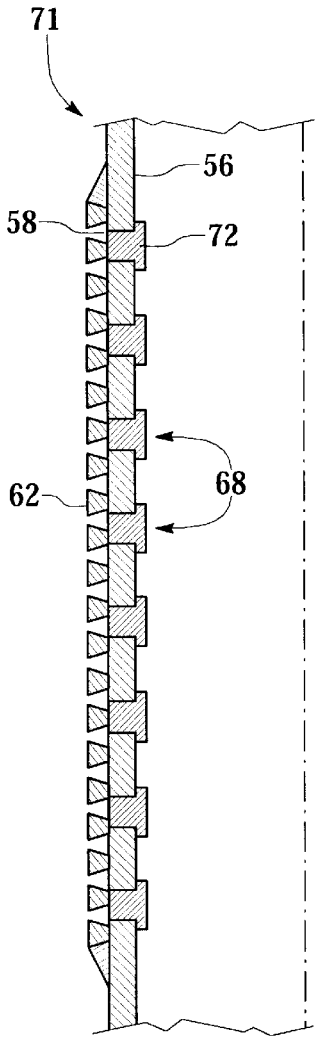
FIG. 4 is a cross sectional view of an alternate embodiment of the sand control screen assembly of the present invention wherein the seal member comprises a plurality of plugs.

Referring now to FIG. 4, therein is depicted an alternative embodiment of a sand control screen assembly that is generally designated 71. Sand control screen assembly 71 includes base pipe 56 having a plurality of openings 58 with screen wire 62 wrapped therearound. Disposed within openings 58 of base pipe 56 are a plurality of plugs 72 that prevent fluid flow through openings 58 and serve as seal member 68 in this embodiment. Following the downhole treatment processes discussed in more detail below, plugs 72 are removed from openings 58 such that production fluids may flow to the interior of sand control screen assembly 71.

Plugs 72 may be any conventional plugs known or unknown in the art, including metal plugs, such as aluminum plugs, ceramic plugs or the like. The techniques used to remove plugs 72 will depend upon the construction of plugs 72. If plugs 72 are formed from an acid reactive material such as aluminum, an acid treatment may be used to remove plugs 72. The acid may be pumped into the interior of sand control screen assembly 71 where it will react with the reactive plugs, thereby chemically removing plugs 72.

Alternatively, regardless of the type of plug, plugs 72 may be mechanically removed. For example, a scraping mechanism may be used to physically contact plugs 72 and remove plugs 72 from the openings 58. As another alternative, if plugs 72 are constructed from propellants, a combustion process may be used to remove plugs 72. Likewise, if plugs 72 are constructed from friable materials such as ceramics, a vibration process, such as sonic vibrations may be used to remove plugs 72.

Figure 5:
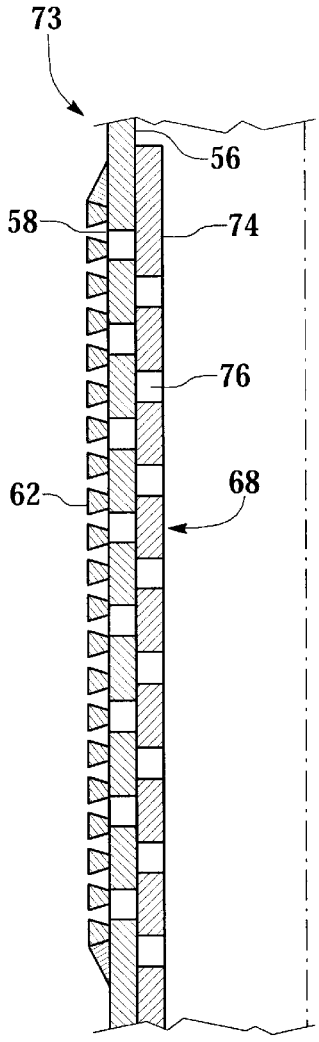
FIG. 5 is a cross sectional view of an alternate embodiment of the sand control screen assembly of the present invention wherein the seal member comprises a sleeve.

Referring now to FIG. 5, an alternative embodiment of a sand control screen assembly is illustrated and generally designated 73. Sand control screen assembly 73 includes base pipe 56 having a plurality of openings 58 with screen wire 62 wrapped therearound. Disposed within base pipe 56 is a sleeve 74 having multiple ports 76 that serves as seal member 68 in this embodiment. When in a first position, ports 76 of sleeve 74 do not align with openings 58 of the base pipe 56. When in a second position, ports 76 of sleeve 74 align with openings 58 of base pipe 56. When sleeve 74 is in the first position, fluid flow from the exterior of sand control screen assembly 73 to the interior of sand control screen assembly 73 is prevented, as is fluid flow from the interior to the exterior of sand control screen assembly 73. When sleeve 74 is in the second position, fluid flow from the exterior of sand control screen assembly 73 to the interior of the sand control screen assembly 73 is allowed, as is fluid flow from the interior to the exterior of sand control screen assembly 73. Sleeve 74 can be displaced between the first position and second position by any conventional means such as axial displacement or rotational displacement. In an alternative embodiment, sleeve 74 can be a removable sleeve in which case ports 76 are not required.

It should be understood by those skilled in the art that other type of seal members 68 may be used to temporarily prevent fluid flow from the interior to the exterior of a sand control screen assembly of the present invention during and following a treatment process of the present invention but allow the flow of production fluids from the exterior to the interior thereof without departing from the principles of the present invention.

Also, it should be understood by those skilled in the art that while FIGS. 2–5 have depicted a wire wrapped sand control screen, other types of filter media could alternatively be used in conjunction with the apparatus of the present invention, including, but not limited to, a fluid-porous, particulate restricting, sintered metal material such as a plurality of layers of a wire mesh that are sintered together to form a porous sintered wire mesh screen designed to allow fluid flow therethrough but prevent the flow of particulate materials of a predetermined size from passing therethrough.

Figure 6:
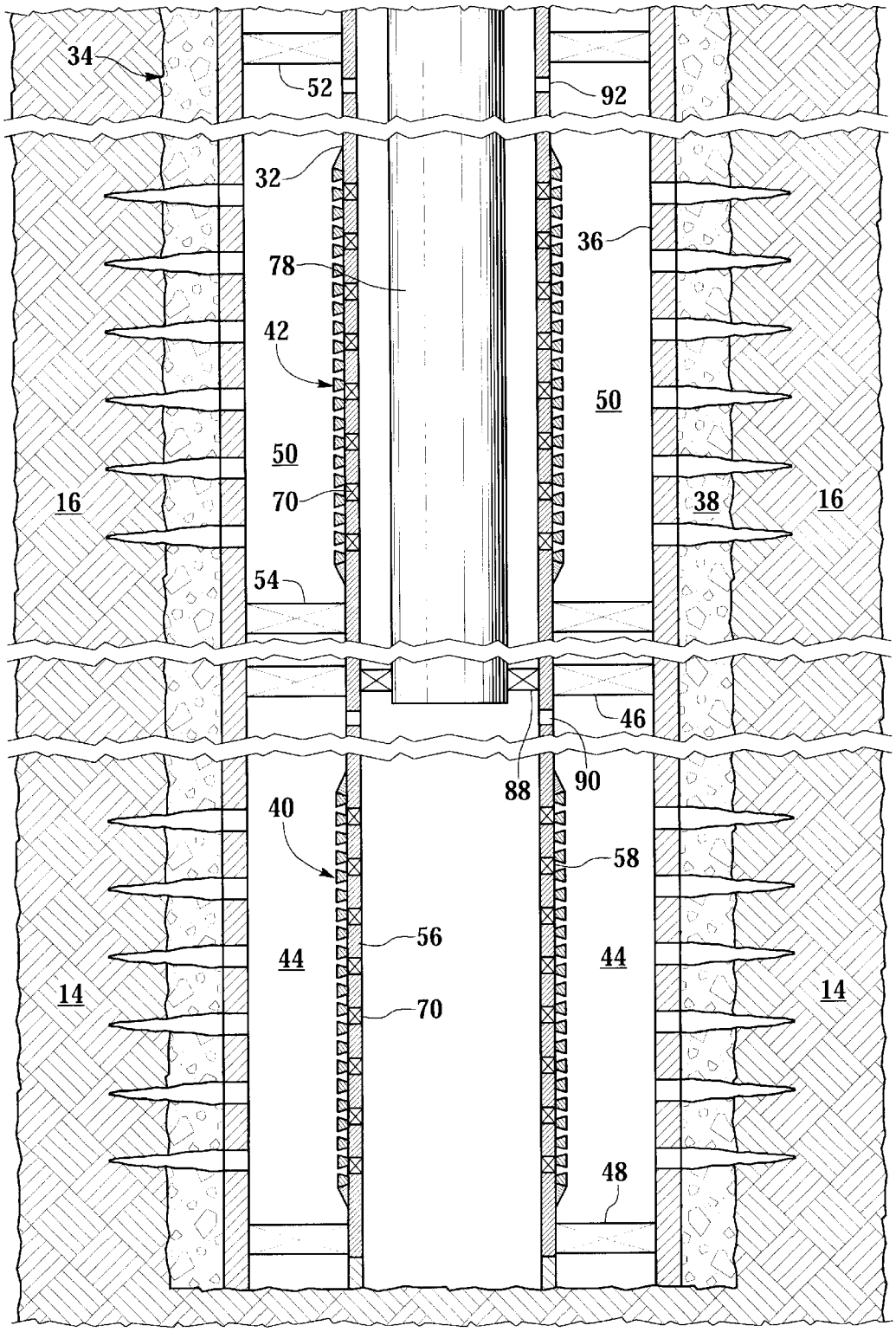
FIG. 6 is a half sectional view of a downhole production environment including a pair of sand control screen assemblies of the present invention before a downhole treatment process.

Referring now to FIG. 6, therein is depicted an embodiment of the present invention that is used during fracturing and frac packing treatments. As illustrated, sand control screen assembly 40 including one-way valves 70, is positioned within casing 36 and is adjacent to formation 14. Likewise, sand control screen assembly 42 including one-way valves 70, is positioned within casing 36 and is adjacent to formation 16. A service tool 78 is positioned within the work string 32. As illustrated by the break between service tool 78 and sand control screen assemblies 40, service tool 78 may be operably positioned several feet to several hundred feet uphole of sand control screen assembly 40.

To begin the completion process, production interval 44 adjacent to formation 14 is isolated. Packer 46 seals the near end of production interval 44 and packer 48 seals the far end of production interval 44. Likewise, production interval 50 adjacent to formation 16 is isolated. Packer 52 seals the near end of production interval 50 and packer 54 seals the far end of production interval 50. Additionally, seal element 88 is coupled to service tool 78. Seal element 88 contacts the interior of work string 32 forming a seal, thereby preventing fluid flow into the annulus between work string 32 and service tool 78. Work string 32 includes cross-over ports 90, 92 that provide a fluid communication path from the interior of work string 32 to production intervals 44, 50, respectively. Preferably, fluid flow through cross-over ports 90, 92 is controlled by suitable valves that are opened and closed by conventional means.

Figure 7:
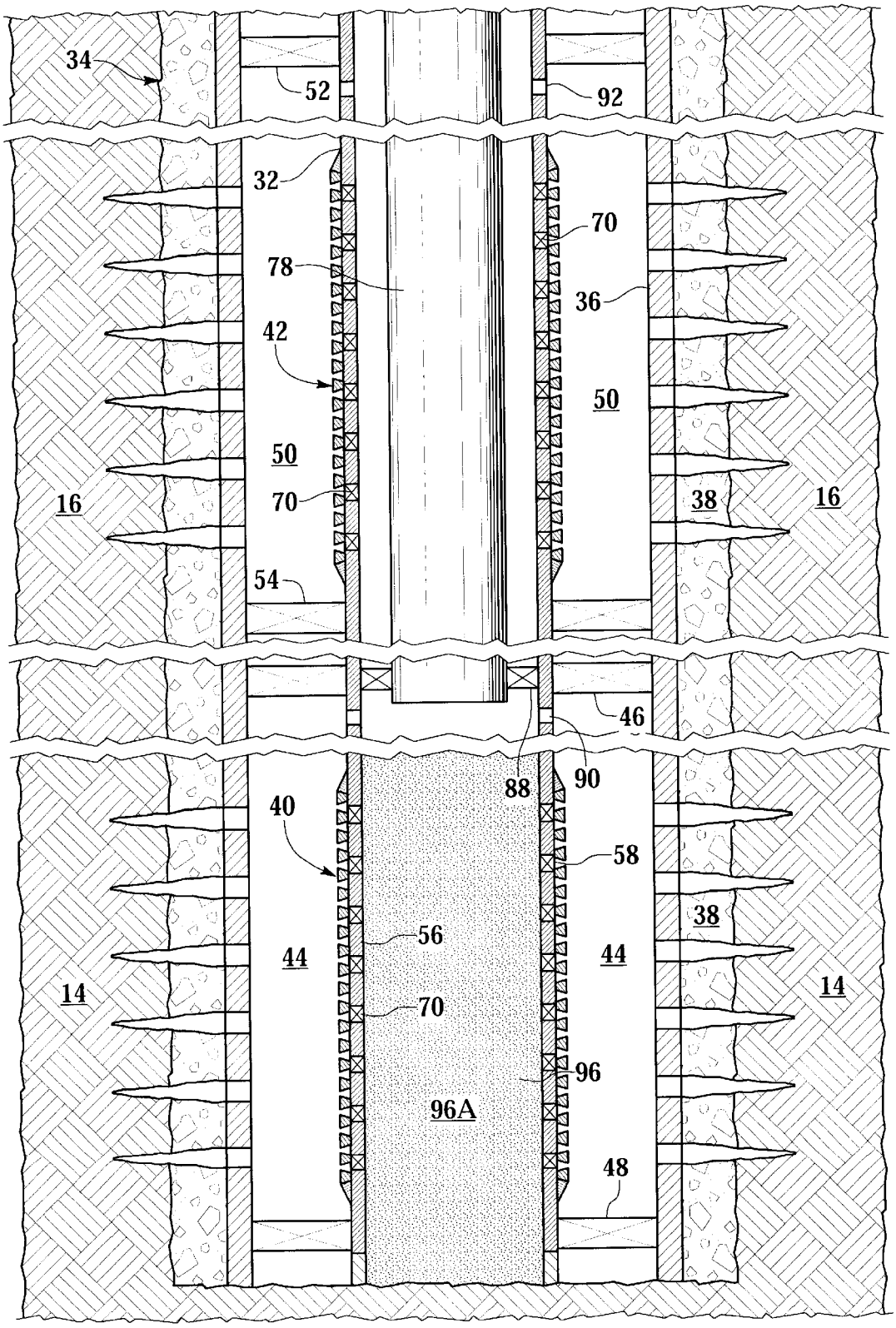
FIG. 7 is a half sectional view of a downhole production environment including a pair of sand control screen assemblies of the present invention during a first phase of a downhole treatment process.

Referring now to FIG. 7, when the treatment operation is a frac pack, the objective is to enhance the permeability of the treated formation by delivering a fluid slurry containing proppants 96 at a high flow rate and in a large volume above the fracture gradient of the formation such that fractures may be formed within the formation 14 and held open by proppants 96. In addition, a frac pack also has the objective of preventing the production of fines by packing production interval 44 with proppants 96.

In the initial phase of the treatment process of the present invention, the interior of sand control screen assemblies 40 is filled with a sand plug 96A. This is achieved by pumping treatment fluid downhole such as a relatively low viscosity oil or water based liquid including a high concentration of solid agents such as sand, gravel or proppants, that will fall out of the slurry relatively easily to form sand plug 96A. Sand plug 96A improves the ability of one-way valves 70 of sand control screen assembly 40 to prevent fluid flow from the interior to the exterior of sand control screen assembly 40. In addition, sand plug 96A prevents sand control screen assembly 40 from seeing the pressure spike that typically occurs at the end of a fracture operation. Accordingly, it is preferred that sand plug 96A extend past the near end of sand control screen assembly 40 as illustrated. It should be noted that his initial phase of the treatment process may not be necessary if sufficient solid agents fall out of the treatment fluids during the fracture or frac packing operations.

Figure 8:
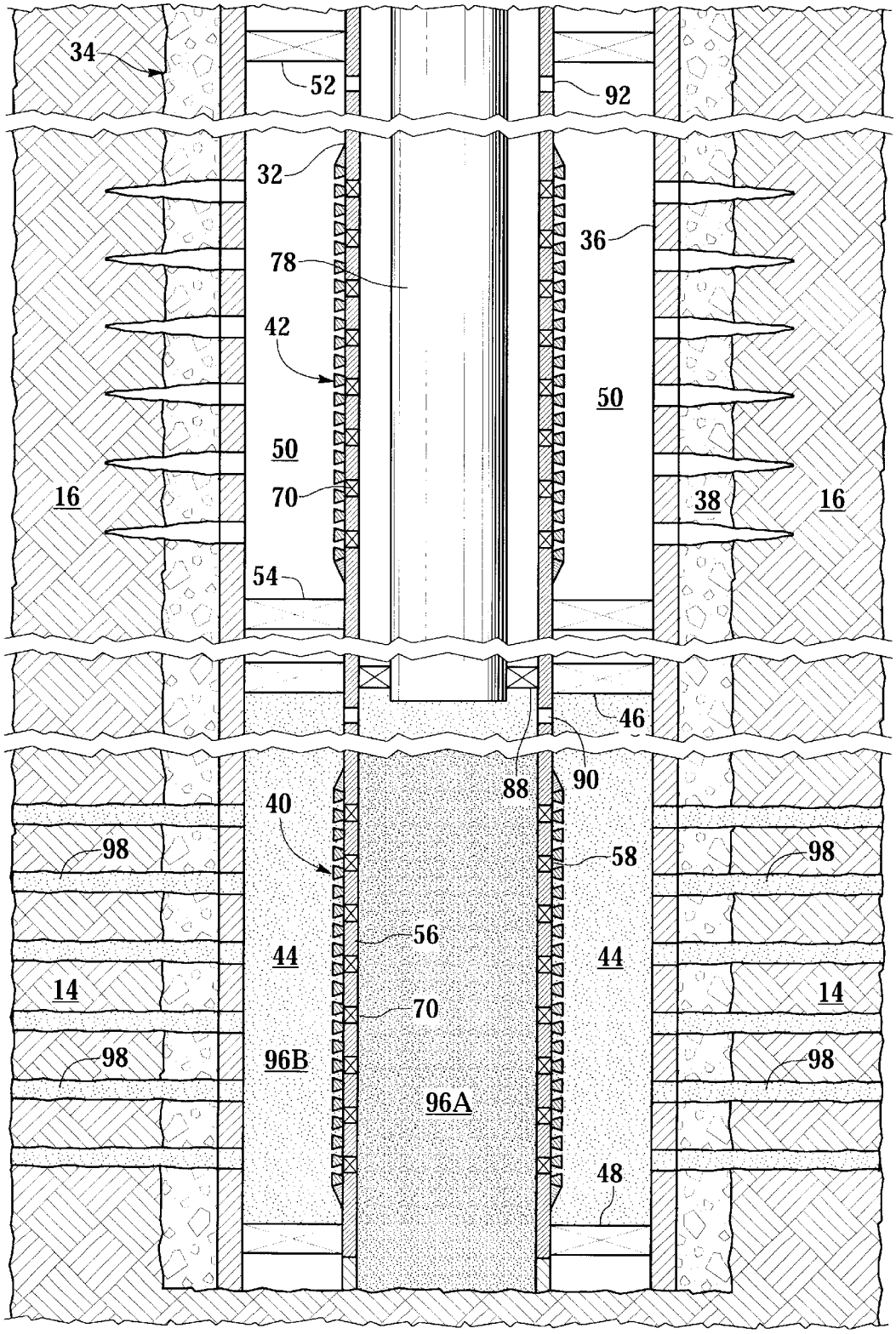
FIG. 8 is a half sectional view of a downhole production environment including a pair of sand control screen assemblies of the present invention during a second phase of a downhole treatment process.

Referring now to FIG. 8, once sand plug 96A is deposited in sand control screen assembly 40, the second phase of the treatment process may begin. The treatment fluid used during the second phase of the treatment process, which is the fracture operation, may be any appropriate fracturing fluid such as oil, water, an oil/water emulsion, gelled water or gelled oil based fracture fluid having a relatively high viscosity to enhance the fracturing process. This treatment fluid may or may not include solid agents such as sand, gravel or proppents but will usually have a lower concentration of solid agents than the treatment fluid of the first phase of the treatment process.

In the illustrated embodiment, the treatment fluid of the second phase of the treatment process includes a low concentration of proppants indicated by reference character 96B. The treatment fluid is pumped through service tool 78 and enters the near end of production interval 44 via cross-over ports 90. As the treatment fluid is being continuously pumped at a high flow rate and in a large volume above the fracture gradient of formation 14 and as no returns are being taken, the treatment fluid fractures formation 14 as indicated by reference character 98.

Figure 9:
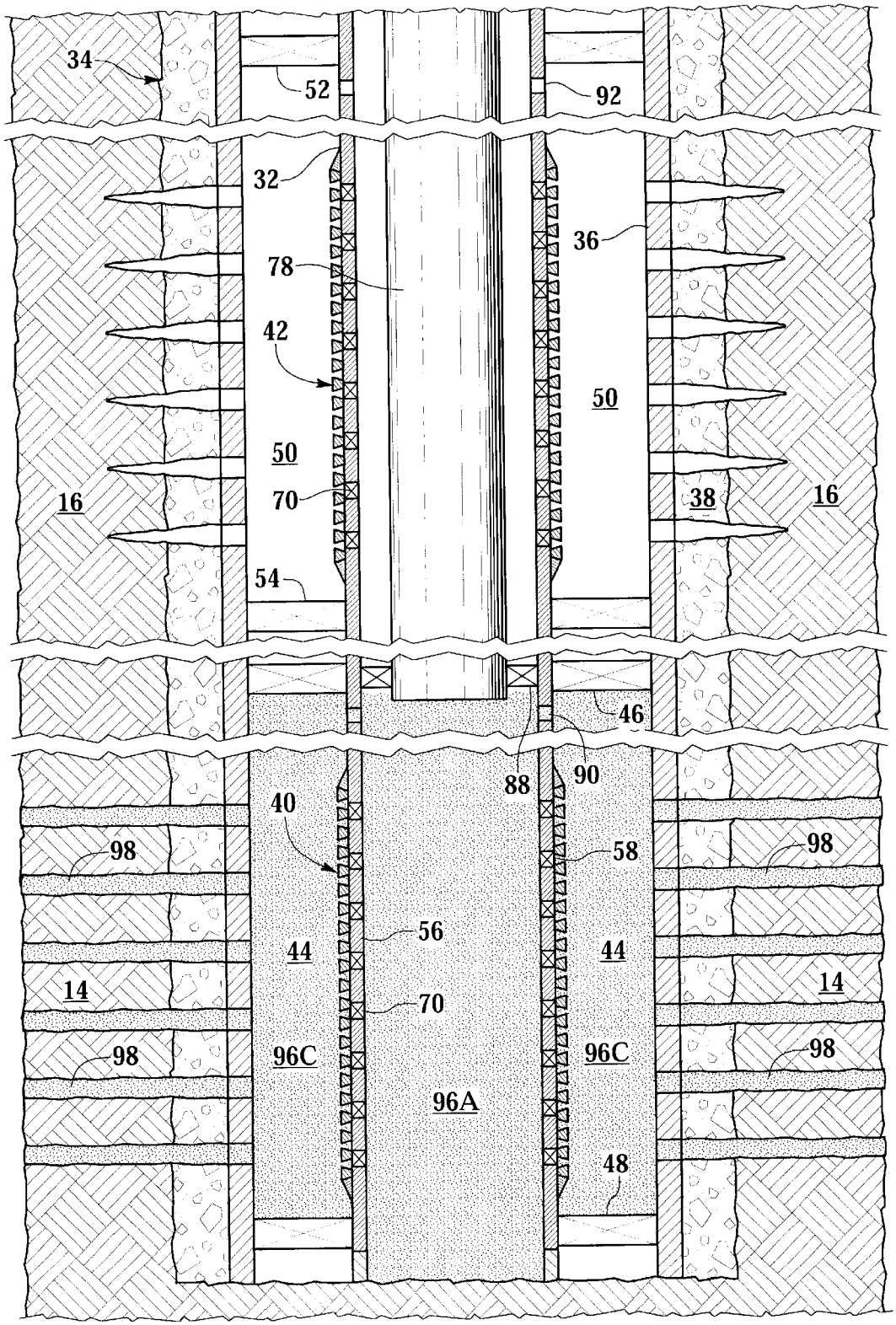
FIG. 9 is a half sectional view of a downhole production environment including a pair of sand control screen assemblies of the present invention during a third phase of a downhole treatment process.

Referring now to FIG. 9, prior to the point at which fractures 98 no longer propagate into formation 14, the third phase of the treatment process begins. The treatment fluid used during this phase may be any suitable fluid such as oil, water, an oil/water emulsion, gelled water or gelled oil based fluid including a suitable solid agent such as gravel, sand or proppants. In this phase of the treatment process, the solid agents travel into the newly created fractures to prop the fractures open and create a path of high permeability back to wellbore 34. In addition, the solid agents fill production interval 44 between sand control screen assembly 40 and casing 36 to form a gravel pack 96C therein which filters particulate matter out of production fluids once production begins. Upon completion of the frac packing of production interval 44, the valves associated with cross-over ports 90 are closed by conventional means.

Figure 10:
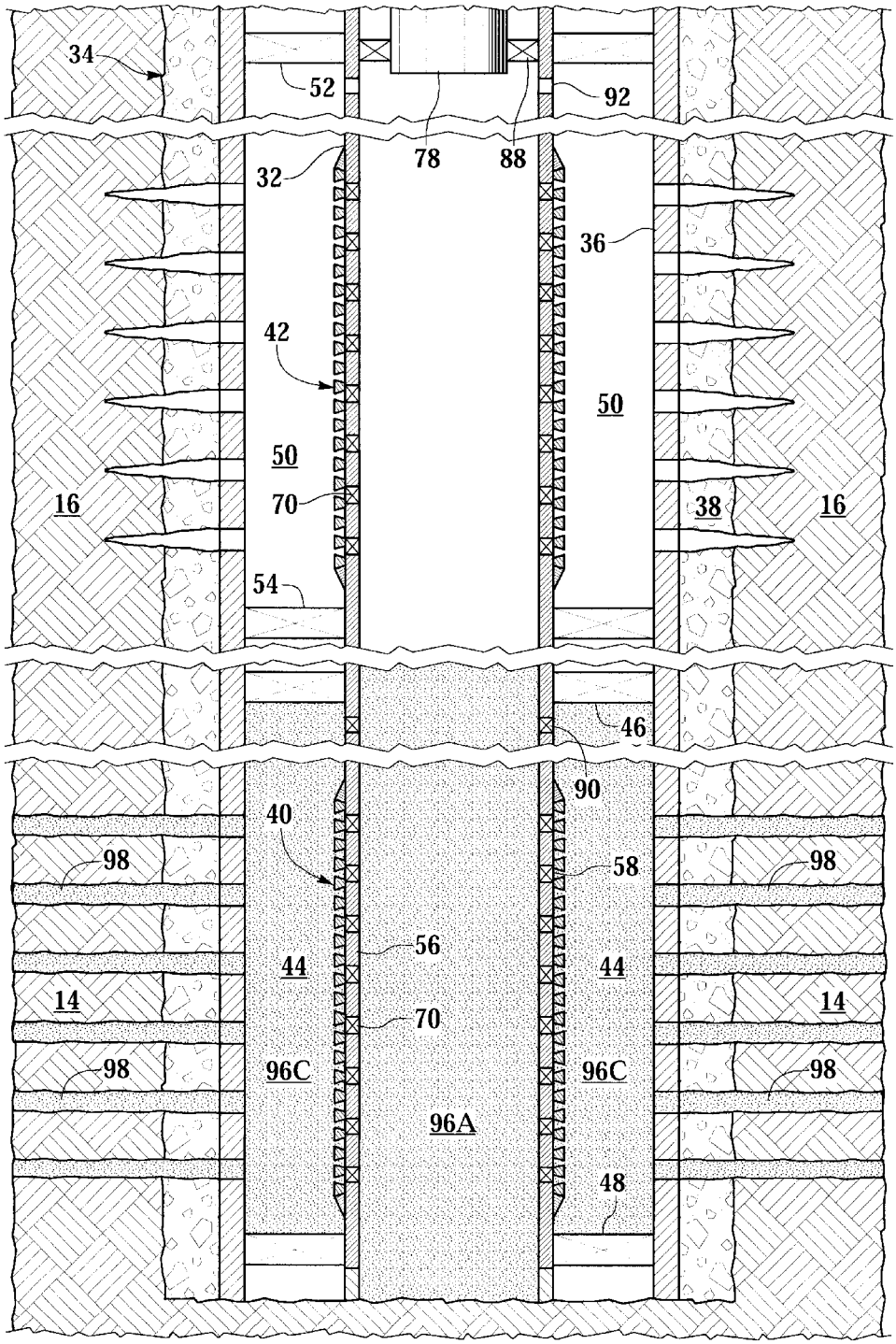
FIG. 10 is a half sectional view of a downhole production environment including a pair of sand control screen assemblies of the present invention during a fourth phase of a downhole treatment process.

Referring now to FIG. 10, following completion of the first frac packing operation, service tool 78 is operably repositioned to frac pack formation 16. As illustrated by the break between service tool 78 and sand control screen assembly 42, the service tool 78 may be several feet to several hundred feet uphole of sand control screen assembly 42. Once service tool 78 is positioned, a three-phase treatment process similar to that described above with reference to FIGS. 7–9 may begin.

Figure 11:
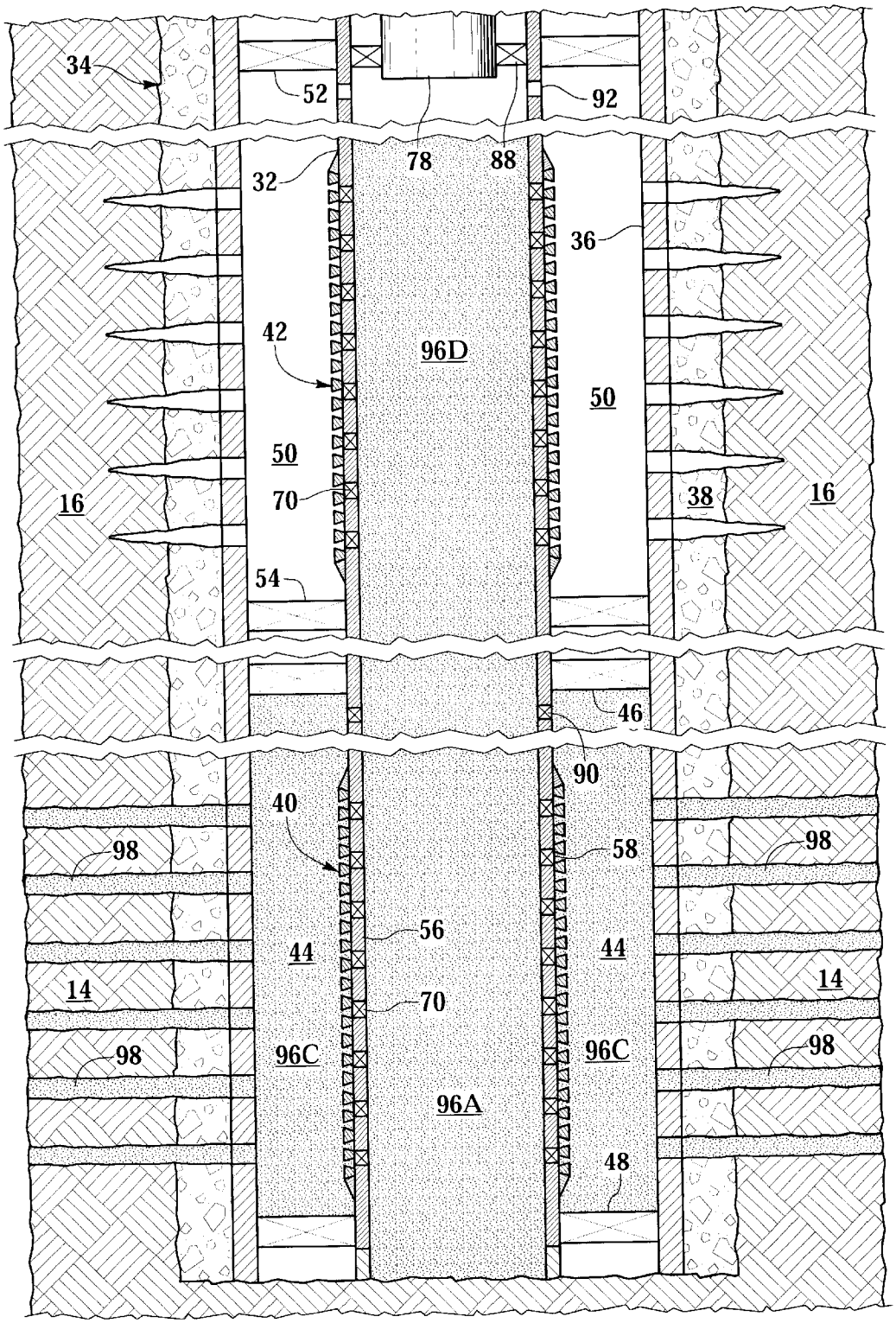
FIG. 11 is a half sectional view of a downhole production environment including a pair of sand control screen assemblies of the present invention during a fifth phase of a downhole treatment process.
Figure 12:
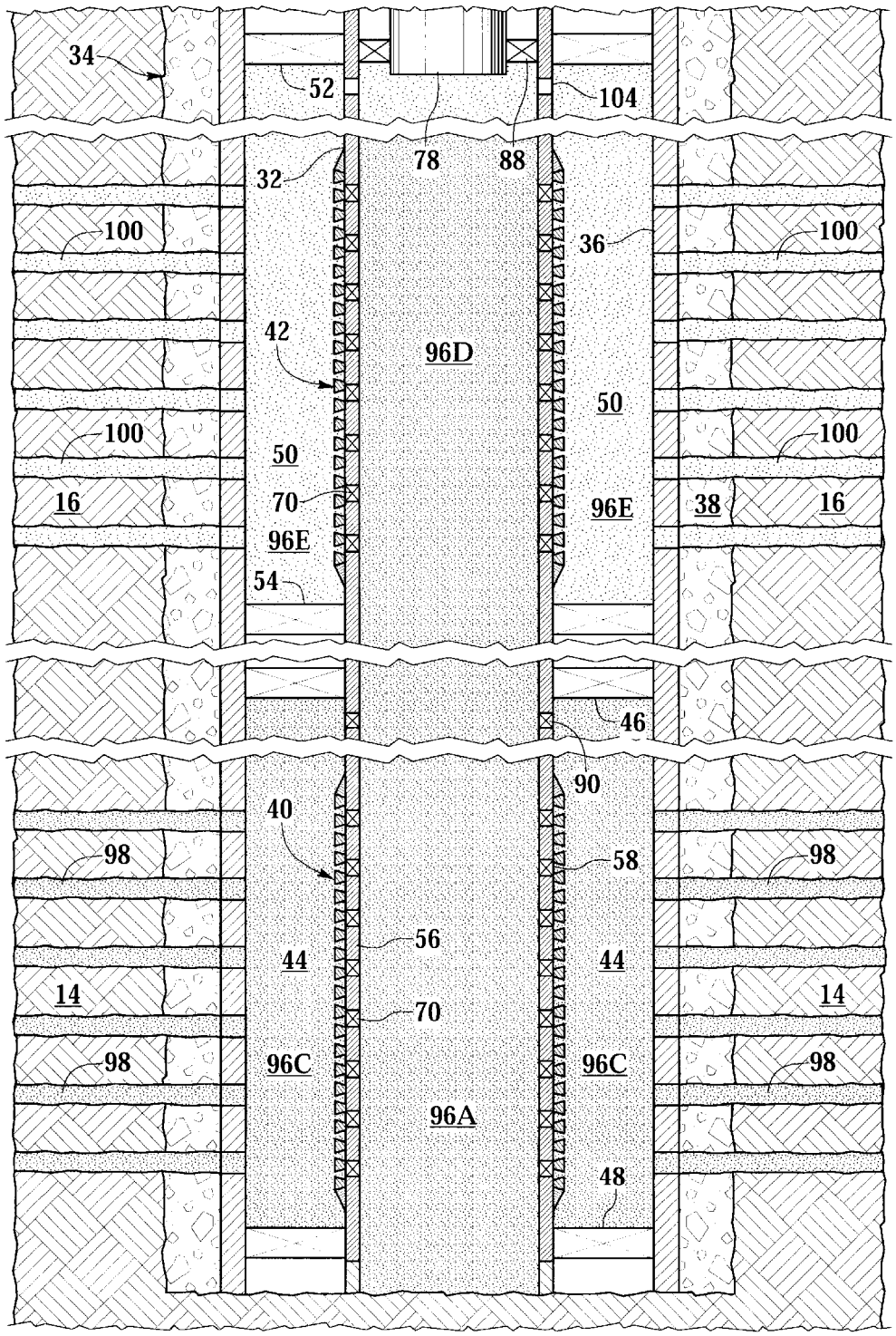
FIG. 12 is a half sectional view of a downhole production environment including a pair of sand control screen assemblies of the present invention during a sixth phase of a downhole treatment process.

Referring now to FIG. 11, the low viscosity treatment fluid with a high concentration of solid agents is pumped into sand control screen assembly 42 to form sand plug 96D. Fracture treatment fluid is then pumped through service tool 78, as best seen in FIG. 12. The treatment fluid enters the near end of production interval 50 via cross-over ports 92. In the illustrated embodiment the fracture fluid contains a low concentration of proppants indicated by 96E. As the fracture fluid is being delivered at a high flow rate and in a large volume above the fracture gradient of formation 16 and as no returns are being taken, the fracture fluids fracture formation 16 as indicated by fractures 100.

Figure 13:
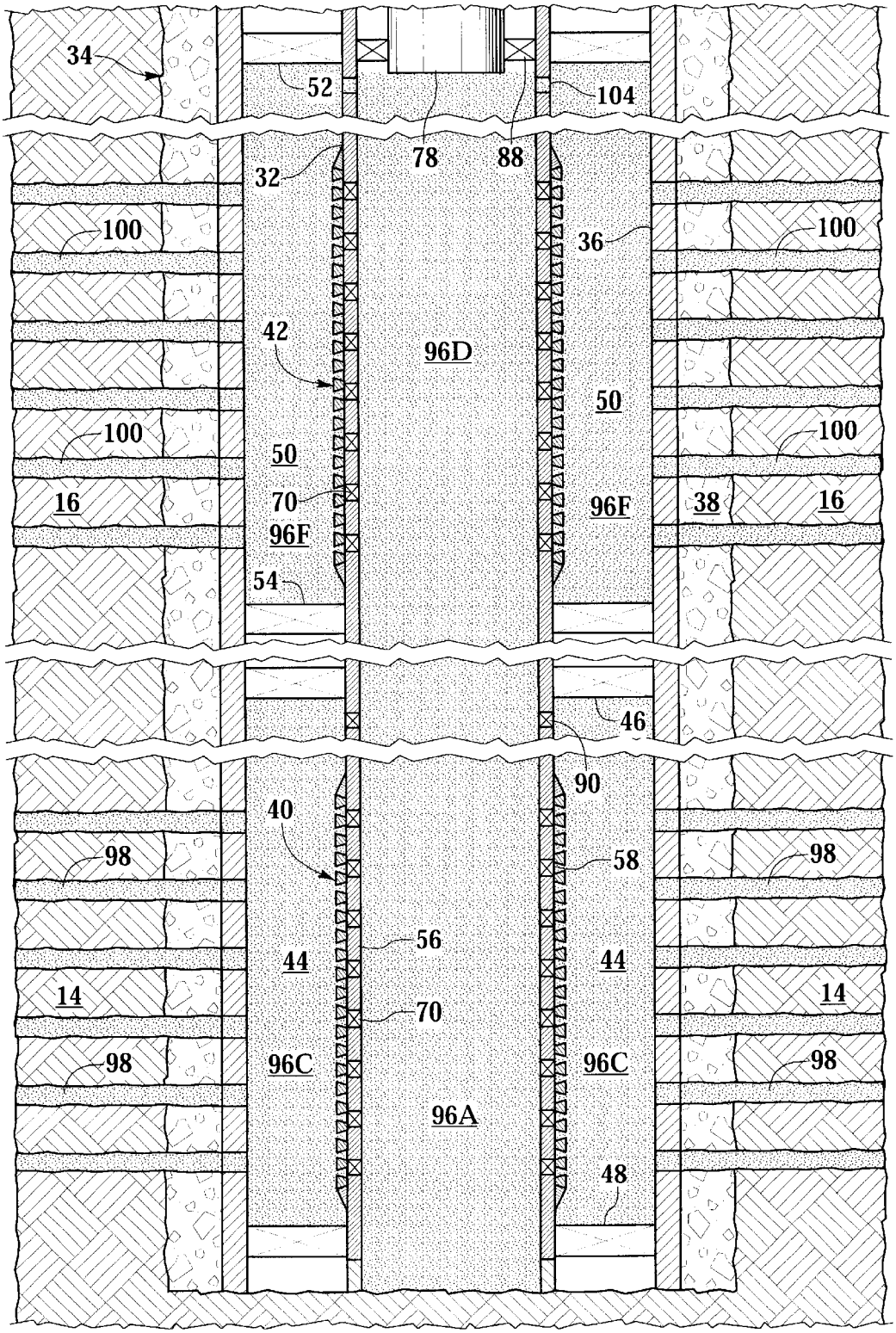
FIG. 13 is a half sectional view of a downhole production environment including a pair of sand control screen assemblies of the present invention during a seventh phase of a downhole treatment process.
Figure 14:
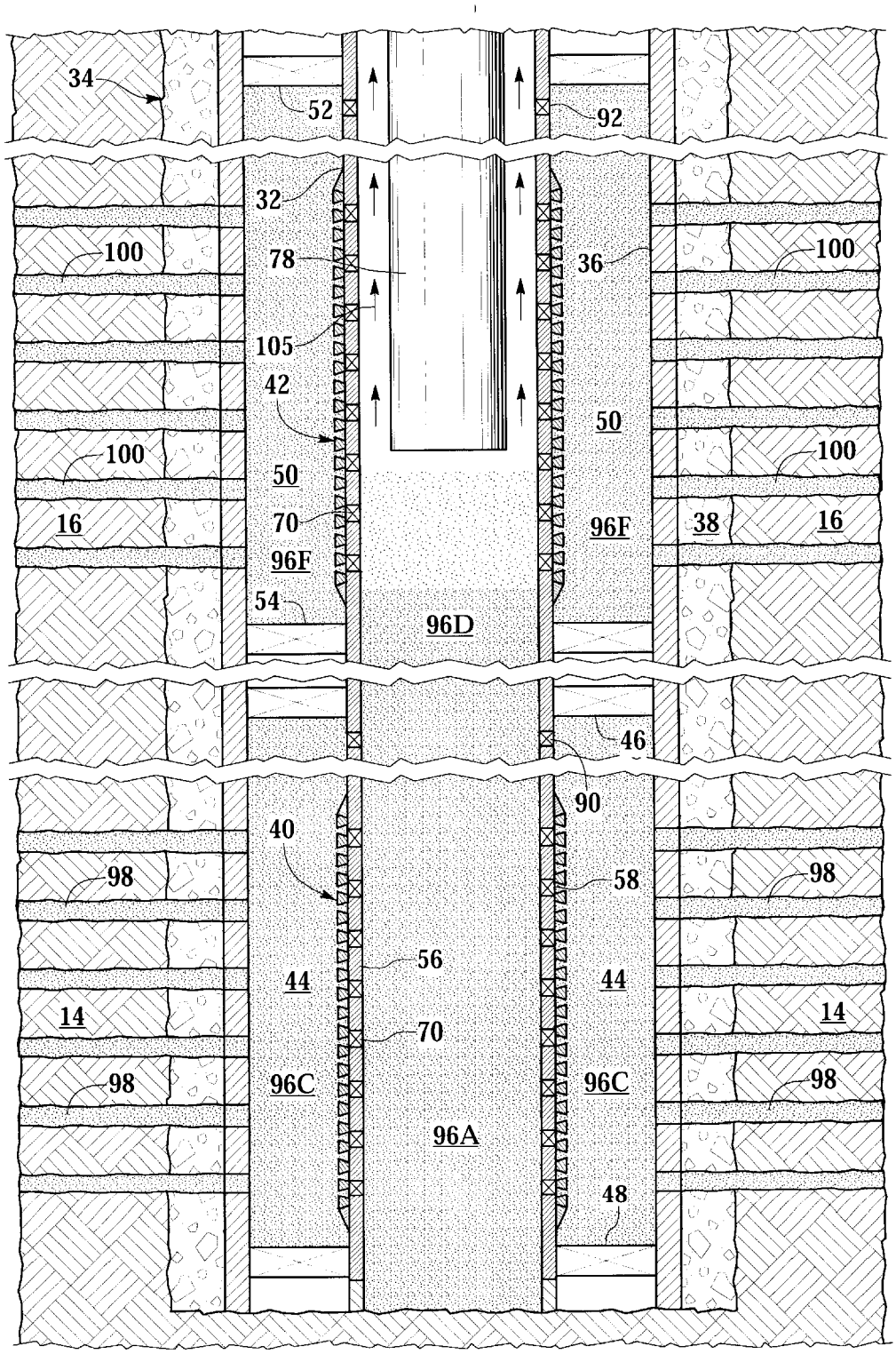
FIG. 14 is a half sectional view of a downhole production environment including a pair of sand control screen assemblies of the present invention during an eighth phase of a downhole treatment process.

Referring now to FIG. 13, toward the end of the fracture operation, the composition of the treatment fluid is changed to include a higher concentration of solid agents. These solid agents are used to prop fractures 100 in formation 16 and to form a gravel pack 96F in production interval 50 between sand control screen assembly 42 and casing 32. This three-phase treatment process can be repeated for any number of formations by repositioning service tool 78 sequentially uphole relative to each of the formations requiring treatment. Once all of the formations are treated and prior to beginning production, sand plugs 96A, 96D must be washed out of sand control screen assemblies 40, 42. As seen in FIG. 14, service tool 78 may be used to wash out the sand control screen assemblies 40, 42 and work string 32.

To wash out sand control screen assemblies 40, 42, liquid is delivered through service tool 78 to mix with the solid agents forming sand plugs 96A, 96D. The mixture is allowed to reverse out of work string 32 via the annulus between service tool 78 and work string 32 as indicated by arrows 102. This process of circulating the solid agents to the surface and lowering service tool 78 farther into work string 32 continues until substantially all the solid agents in work string 32 have been removed.

As explained above, different compositions of treatment fluids are used in the above described method during the different phases of the treatment process. Preferably, the first treatment fluid has a higher concentration of solid agents than the second treatment fluid. The first treatment fluid requires a higher concentration of solid agents as it is intended to place a sand plug in the sand control screen assemblies. The second treatment fluid does not require such solid agents as it is intended to fracture the formations. Additionally, the first treatment fluid preferably has a lower density and lower viscosity than the second treatment fluid. The lower density and lower viscosity in the first treatment fluid allows the solid agents to fall out of the slurry easily. The higher density and higher viscosity of the second treatment fluid allows the second treatment fluid to effectively fracture the formation.

The third treatment fluid preferably has a higher concentration of solid agents than the second treatment fluid. The third treatment fluid props the fractures and gravel packs the production intervals surrounding the sand control screen assemblies. Therefore, a higher concentration of solid agents is desirable in the third treatment fluid. Additionally, the third treatment fluid may have a lower density and lower viscosity than the second treatment fluid. The lower density and lower viscosity in the third treatment fluid allows the solid agents to fall out of the slurry more readily.

As should be apparent to those skilled in the art, the above described method allows the use of a relatively simple service tool 78 that allows for the treatment of multiple formations that are relatively close together. This is achieved by using sand control screen assemblies 40, 42 that include one-way valves 70 that prevent the flow of fluids from the interior to the exterior of sand control screen assemblies 40, 42. Accordingly, fewer tools are required between sand control screen assemblies 40, 42, thereby the distance between sand control screen assemblies 40, 42 may be reduced. This reduced distance and the simplicity of service tool 78 allow relatively narrow and relatively closely spaced formations to be treated according to the present invention.

Figure 15:
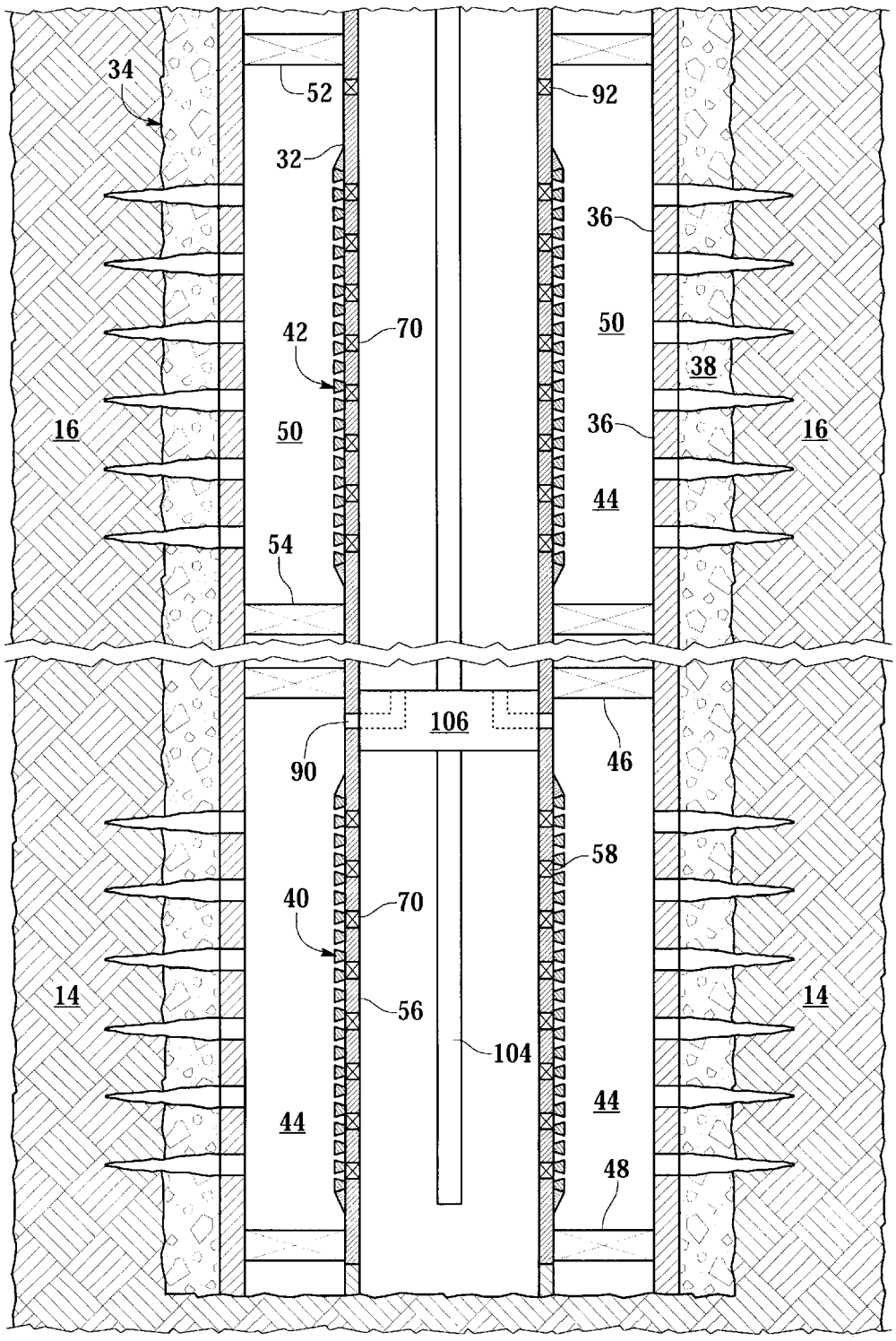
FIG. 15 is a half sectional view of a downhole production environment including a pair of sand control screen assemblies of the present invention before a downhole treatment process.

Referring now to FIG. 15, therein is depicted an embodiment of the present invention that is used during a gravel packing treatment. As illustrated, sand control screen assembly 40 having one-way valves 70 is positioned within casing 36 and is adjacent to formation 14. Similarly, sand control screen assembly 42 having one-way valve 70 is positioned within casing 36 and is adjacent to formation 16. A wash pipe 104 extends through work string 32 traversing cross-over assembly 106. Cross-over assembly 106 is positioned within work string 32 adjacent to cross-over ports 90 that include valves therein as explained above.

Sand control screen assemblies 40, 42 each have a filter media associated therewith that is designed to allow fluid to flow therethrough but prevent particulate matter of sufficient size from flowing therethrough. The exact design of the filter media of sand control screen assemblies 40, 42 is not critical to the present invention as long as it is suitably designed for the characteristics of the formation fluids and the treatment fluids. One-way valves 70 of sand control screen assemblies 40, 42 may be of any suitable type so long as they prevent fluid flow from the interior to the exterior of sand control screens 40, 42.

To begin the gravel packing completion process, production interval 44 proximate formation 14 and production interval 50 proximate second formation 16 are isolated. Packer 46 seals the near end of production interval 44 and packer 48 seals the far end of production interval 44. Similarly, packer 52 seals the near end of production interval 50 and packer 54 seals the far end of production interval 50. Initially, as illustrated, the cross-over assembly 106 is located proximate to sand control screen assembly 40 and aligned with cross-over ports 90.

Figure 16:
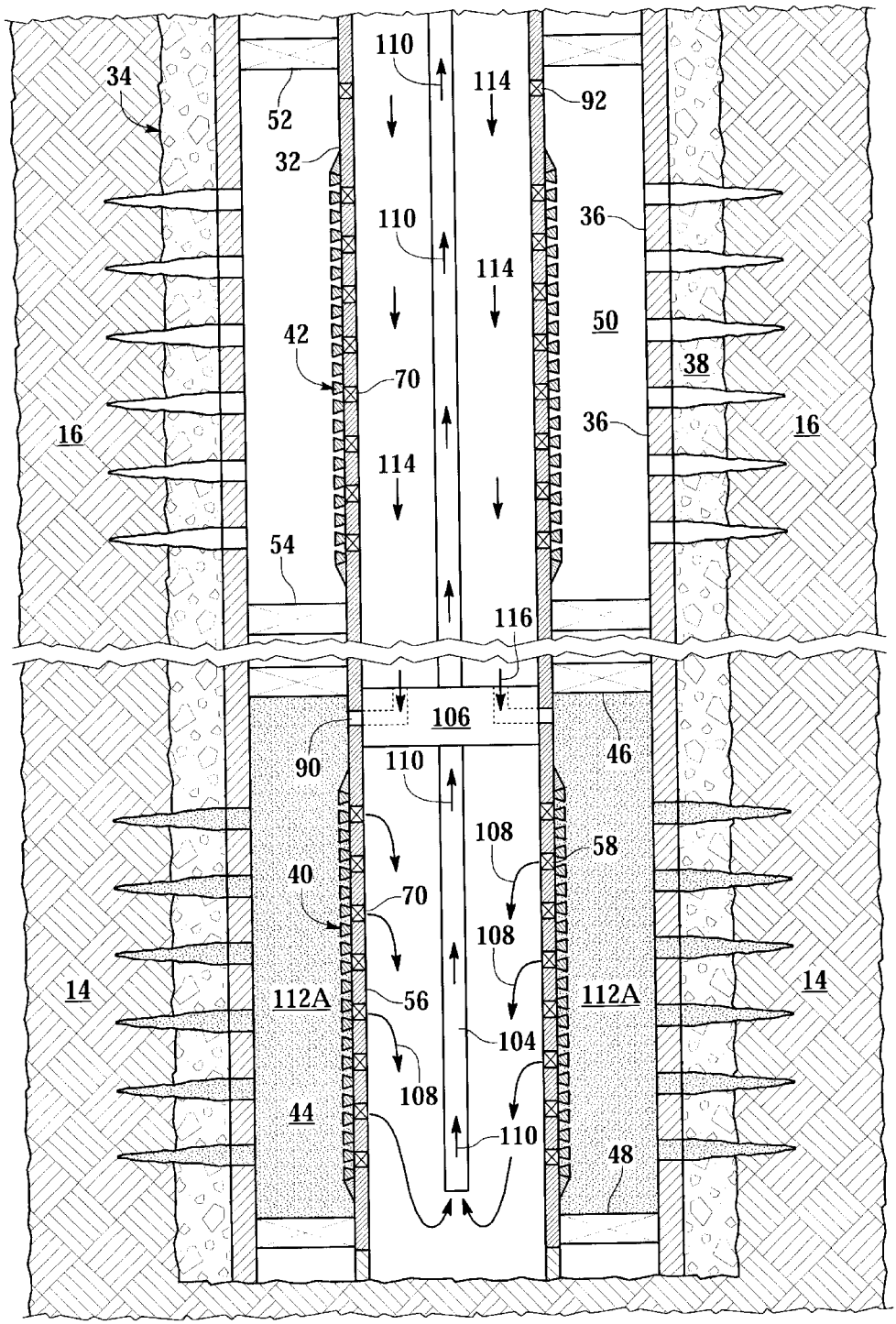
FIG. 16 is a half sectional view of a downhole production environment including a pair of sand control screen assemblies of the present invention during a first phase of a downhole treatment process.

Referring to FIG. 16, when the treatment operation is a gravel pack, the objective is to uniformly and completely fill production interval 44 between sand control screen assembly 40 and casing 36 with gravel. To help achieve this result, return fluid is taken through sand control screen assembly 40, indicated by arrows 108, and travels through wash pipe 104, as indicated by arrows 110, for return to the surface.

More specifically, a treatment fluid, in this case a fluid slurry containing gravel 112 is pumped downhole in work string 32, as indicated by arrows 114, and into production interval 48 via cross-over assembly 106, as indicated by arrows 116. As the fluid slurry containing gravel 112 travels to the far end of production interval 48, gravel 112 drops out of the slurry and builds up from formation 14, filling the perforations and production interval 48 around sand control screen assembly 40 forming gravel pack 112A. While some of the carrier fluid in the slurry may leak off into formation 14, the remainder of the carrier fluid passes through sand control screen assembly 40 through one-way valves 70, as indicated by arrows 108. The fluid flowing back through sand control screen assembly 40, as explained above, follows the paths indicated by arrows 110 back to the surface.

Figure 17:
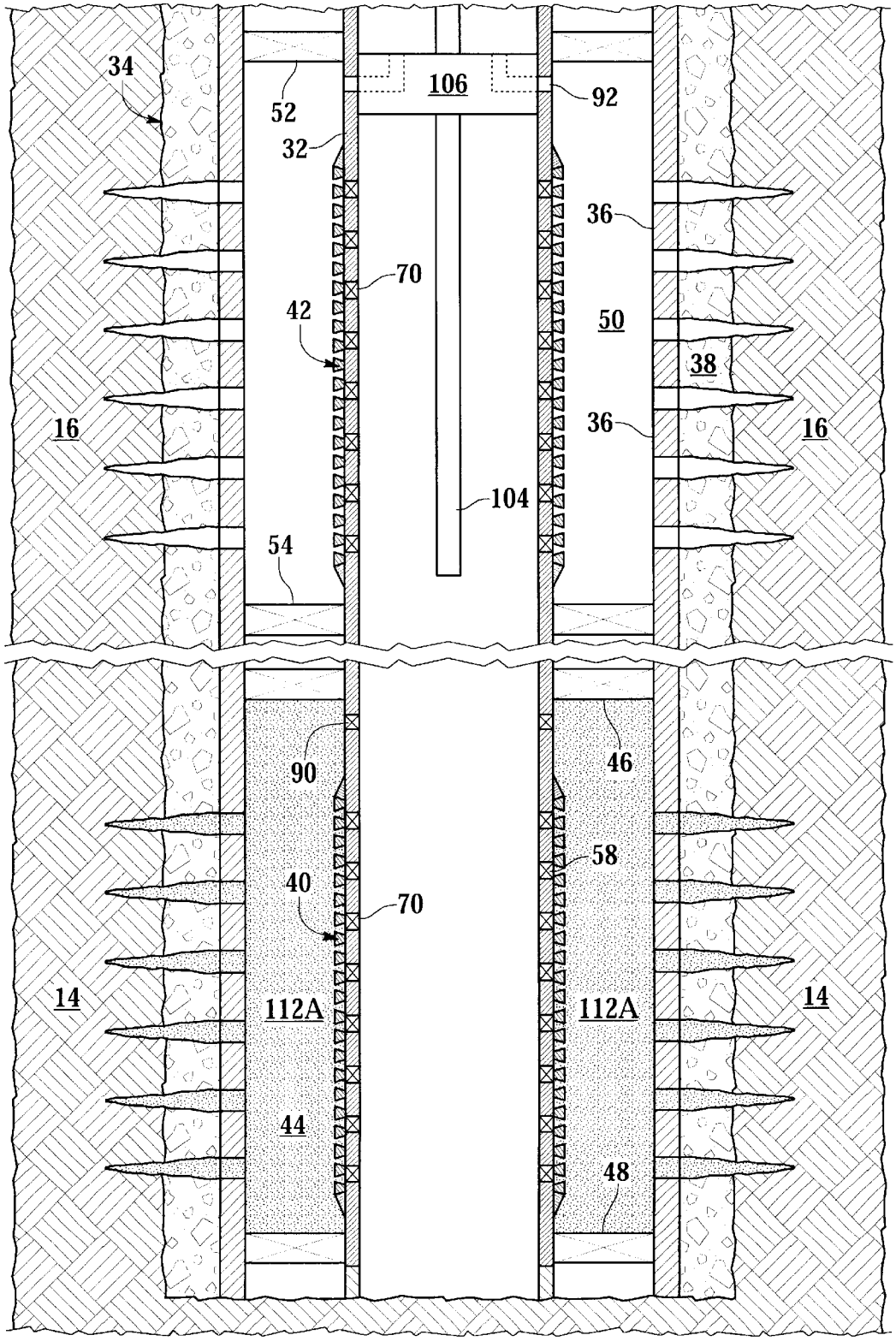
FIG. 17 is a half sectional view of a downhole production environment including a pair of sand control screen assemblies of the present invention during a second phase of a downhole treatment process.

After the gravel packing operation of production interval 44 is complete, cross-over assembly 106 and wash pipe 104 may be moved uphole such that other production intervals may be gravel packed, such as production interval 50, as best seen in FIG. 17. As the distance between formation 14 and formation 16 may be hundreds or even thousands of feet and as there may be any number of production intervals that require gravel packing, there may be a considerable amount of time between the gravel packing of production interval 44 and eventual production from formation 14. It has been found that in conventional completions, considerable fluid loss may occur from the interior of sand control screen assembly 40 through gravel pack 112A and into formation 14. This fluid loss is not only costly but may also damage gravel pack 112A, formation 14 or both. Using the sand control screen assemblies of the present invention, however, prevents such fluid loss using a seal member, in this case, one-way valves 70, positioned within sand control screen assembly 40. Accordingly, one-way valves 70 not only save the expense associated with fluid loss but also protect gravel pack 112A and formation 14 from the damage caused by fluid loss.

Figure 18:
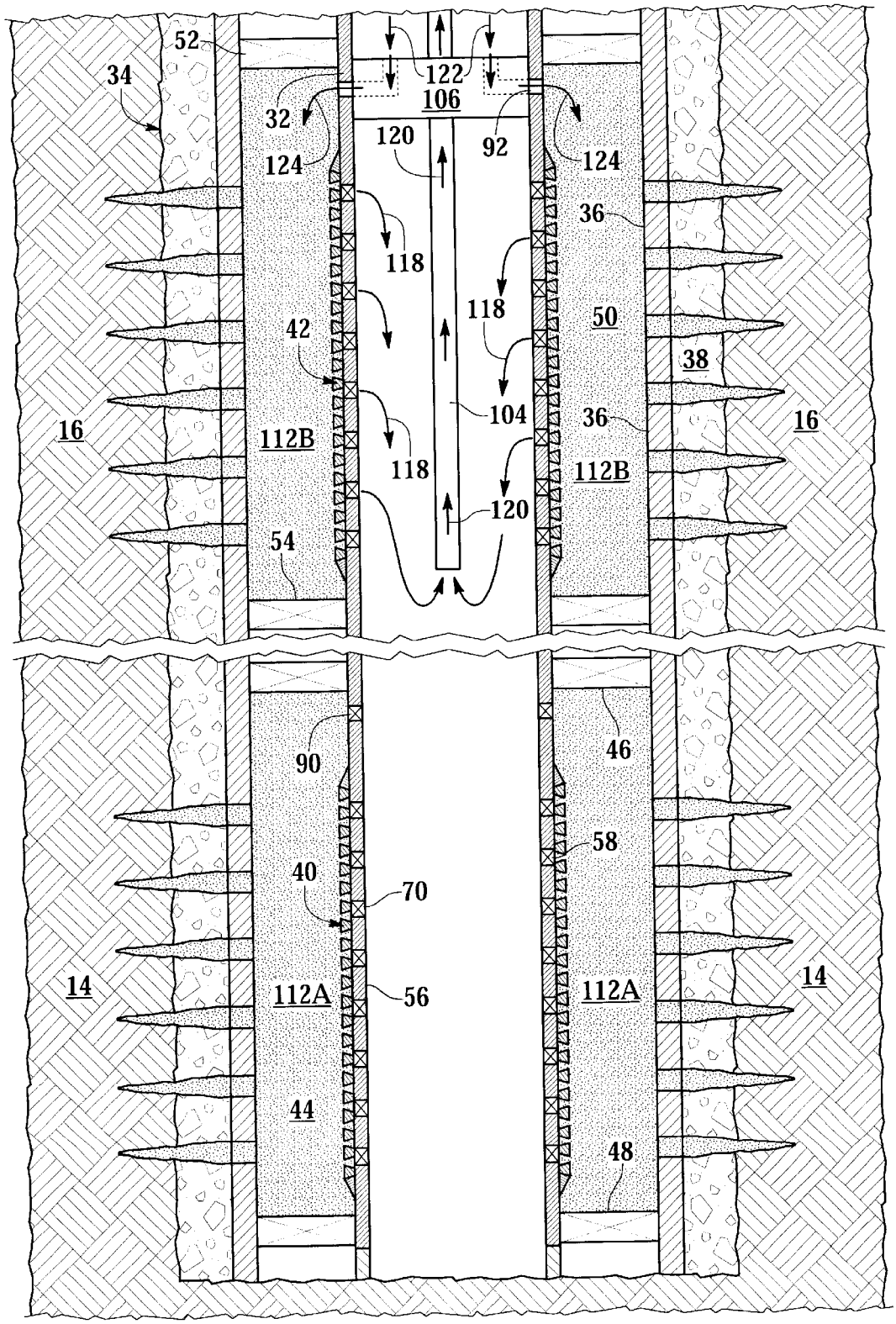
FIG. 18 is a half sectional view of a downhole production environment including a pair of sand control screen assemblies of the present invention during a third phase of a downhole treatment process.

Referring to FIG. 18, the process of gravel packing production interval 50 is depicted. Wash pipe 104 is now disposed within sand control screen assembly 42. Wash pipe 104 extends through cross-over assembly 106 such that return fluid passing through sand control screen assemblies 42, indicated by arrows 118, and travels through wash pipe 104, as indicated by arrows 120, for return to the surface.

The fluid slurry containing gravel 112 is pumped downhole through work string 32, as indicated by arrows 122, and into production interval 50 via cross-over assembly 106 and cross-over ports 92, as indicated by arrows 124. As the fluid slurry containing gravel 112 travels to the far end of production interval 50, the gravel 112 drops out of the slurry and builds up from formation 16, filling the perforations and production interval 50 around sand control screen assemblies 42 forming gravel pack 112B. While some of the carrier fluid in the slurry may leak off into formation 16, the remainder of the carrier fluid passes through sand control screen assemblies 42 through one-way valves 70, as indicated by arrows 118. The fluid flowing back through sand control screen assembly 42, as explained above, follows the paths indicated by arrows 120 back to the surface. Once gravel pack 112B is complete, cross-over assembly 106 may again be repositioned uphole to gravel pack additional production intervals. As explained above, using sand control screen assembly 42 prevents fluid loss from the interior of sand control screen assembly 42 to formation 16 during such subsequent operations.

As should be apparent to those skilled in the art, even though FIGS. 6–18 present the treatment of multiple intervals of a wellbore in a vertical orientation with packers at the top and bottom of the production interval, these figures are intended to also represent wellbores that have alternate directional orientations such as inclined wellbores and horizontal wellbores. In the horizontal orientation, for example, packer 46 is at the heel of production interval 44 and packer 48 is at the toe of production interval 44. Likewise, while multiple production intervals have been described as being treated during a single trip, the methods described above are also suitable for treating a single production interval traversed by a wellbore or may be accomplished in mulitple trips into a wellbore.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen assembly positionable within a production interval comprising:

a base pipe having a plurality of openings that allow fluid flow therethrough;

a filter medium positioned about the exterior of the base pipe, the filter medium selectively allowing fluid flow therethrough and preventing particulate flow therethrough; and a sleeve disposed within the base pipe that controls fluid flow through the openings of the base pipe.

2. The sand control screen assembly as recited in claim 1 wherein the sleeve further comprises a plurality of ports, the sleeve having a first position and a second position relative to the base pipe, in the first position, the ports of the sleeve are not aligned with the openings of the base pipe, in the second position, the ports of the sleeve are aligned with the openings of the base pipe.

3. The sand control screen assembly as recited in claim 2 wherein the sleeve is axially displaceable between the first position and the second position.

4. The sand control screen assembly as recited in claim 2 wherein the sleeve is rotatably displaceable between the first position and the second position.

5. The sand control screen assembly as recited in claim 1 wherein the sleeve is removable.

6. A sand control screen assembly positionable within a production interval of a wellbore comprising:

a base pipe having a plurality of openings that allow fluid flow therethrough;

a filter medium positioned about the exterior of the base pipe, the filter medium selectively allowing fluid flow therethrough and preventing particulate flow therethrough; and at least one valve operably associated with the openings of the base pipe, the at least one valve prevents fluid flow from the interior of the base pipe to the exterior of the base pipe and is actuatable to allow fluid flow from the exterior of the base pipe to the interior of the base pipe.

7. A downhole treatment method comprising the steps of:

locating a sand control screen assembly within a production interval of a wellbore, the sand control screen assembly including a base pipe having a plurality of openings and a filter medium positioned about an exterior of the base pipe;

preventing fluid flow from the interior to the exterior of the sand control screen assembly with a sleeve disposed within the base pipe that controls fluid flow through the openings of the base pipe; and pumping a treatment fluid into the production interval.

8. The method as recited in claim 7 further comprising the step of allowing fluid flow through the base pipe by axially shifting the sleeve from a first position to a second position to align ports in the sleeve with the openings of the base pipe.

9. The method as recited in claim 7 further comprising the step of allowing fluid flow through the base pipe by rotatably shifting the sleeve from a first position to a second position to align ports in the sleeve with the openings of the base pipe.

10. The method as recited in claim 7 further comprising the step of allowing fluid flow through the base pipe by removing the sleeve.

11. The method as recited in claim 7 wherein the step of pumping a treatment fluid into the production interval further comprises pumping a fracture fluid into the production interval and fracturing a formation.

12. The method as recited in claim 7 wherein the step of pumping a treatment fluid into the production interval further comprises pumping a gravel packing fluid into the production interval and gravel packing the production interval.

13. The method as recited in claim 7 further comprising the step of continuing to prevent fluid flow from the interior to the exterior of the sand control screen assembly after terminating the pumping of the treatment fluid.

14. A method for fracturing a formation traversed by a wellbore comprising the steps of:

locating a sand control screen assembly within the wellbore proximate the formation, the sand control screen assembly including a base pipe having a plurality of openings and a filter medium positioned about the exterior of the base pipe;

preventing fluid flow from the interior to the exterior of the sand control screen assembly with at least one valve operably associated with the base pipe that controls fluid flow through the openings of the base pipe;

pumping a fracture fluid into the formation; and fracturing the formation.

15. The method as recited in claim 14 further comprising the step of continuing to prevent fluid flow from the interior to the exterior of the sand control screen after terminating the pumping of the fracture fluid.

16. A downhole treatment method comprising the steps of:

locating a sand control screen assembly within a production interval of a wellbore;

after the locating step, filling the interior of the sand control screen assembly with a sand plug; and treating the production interval.

17. The method as recited in claim 16 wherein the step of treating the production interval further comprises the steps of pumping a fracture fluid into a formation traversed by the wellbore and fracturing the formation.

18. The method as recited in claim 16 wherein the step of filling the interior of the sand control screen assembly with a sand plug comprises the step of preventing fluid flow from the interior to the exterior of the sand control screen assembly.

19. The method as recited in claim 16 wherein the step of treating the production interval further comprises the step of pumping a gravel packing fluid into the production interval and gravel packing the production interval.

20. The method as recited in claim 16 wherein the step of filling the interior of the sand control screen assembly with a sand plug further comprises pumping a first treatment fluid containing first solid agents into the interior of the sand control screen assembly and wherein the step of treating the production interval further comprises the steps of pumping a second treatment fluid into a formation traversed by the wellbore, pumping a third treatment fluid containing second solid agents into the production interval, and terminating the pumping of the third treatment fluid when the production interval is packed with the second solid agents.

21. The method as recited in claim 20 wherein the step of pumping a second treatment fluid further comprises pumping a second treatment fluid comprising third solid agents.

22. The method as recited in claim 21 wherein the concentration of the third solid agents in the second treatment fluid is lower than the concentration of first solid agents in the first treatment fluid.

23. The method as recited in claim 21 wherein the concentration of the third solid agents in the second treatment fluid is lower than the concentration of second solid agents in the third treatment fluid.

24. The method as recited in claim 20 further comprising the step of preventing fluid flow from the interior to the exterior of the sand control screen assembly with at least one valve operably associated with a base pipe of the sand control screen assembly that controls fluid flow through openings of the base pipe.

25. The method as recited in claim 20 further comprising the step of preventing fluid flow from the interior to the exterior of the sand control screen assembly with a seal member operably associated with a base pine of the sand control screen assembly that controls fluid flow through openings of the base pine.

26. The method as recited in claim 20 wherein the viscosity of the second treatment fluid is higher than the viscosity of the first treatment fluid.

27. The method as recited in claim 20 wherein the viscosity of the second treatment fluid is higher than the viscosity of the third treatment fluid.

28. A method for treating a formation traversed by a wellbore comprising the steps of:

positioning a sand control screen assembly into a work string and locating the sand control screen assembly within a production interval of the wellbore proximate the formation;

pumping a first treatment fluid containing first solid agents through the work string into the interior of the sand control screen assembly;

pumping a second treatment fluid through the work string into the formation;

pumping a third treatment fluid containing second solid agents into the production interval; and terminating the pumping of the third treatment fluid.

29. The method as recited in claims 25 wherein the step of pumping a second treatment fluid further comprises pumping a second treatment fluid comprising third solid agents.

30. The method as recited in claim 29 wherein the concentration of third solid agents in the second treatment fluid is lower than the concentration of first solid agents in the first treatment fluid.

31. The method as recited in claim 29 wherein the concentration of third solid agents in the second treatment fluid is lower than the concentration of second solid agents in the third treatment fluid.

32. The method as recited in claim 28 further comprising the step of preventing fluid flow from the interior to the exterior of the sand control screen assembly with at least one valve operably associated with a base pipe of the sand control screen assembly that controls fluid flow through openings of the base pipe.

33. The method as recited in claim 28 further comprising the step of preventing fluid flow from the interior to the exterior of the sand control screen assembly with a seal member operably associated with a base pipe of the sand control screen assembly that controls fluid flow through openings of the base pine.

34. The method as recited in claim 28 wherein the viscosity of the second treatment fluid is higher than the viscosity of the first treatment fluid.

35. The method as recited in claim 28 wherein the viscosity of the second treatment fluid is higher than the viscosity of the third treatment fluid.

36. A single trip method for treating multiple formations traversed by a wellbore comprising the steps of:

respectively positioning at least two sand control screen assemblies within production intervals of the wellbore proximate the formations;

preventing fluid flow from the interior to the exterior of the sand control screen assemblies;

operably positioning a service tool relative to one of the sand control screen assemblies;

pumping a treatment fluid through the service tool into one of the production intervals;

terminating the pumping the treatment fluid;

operably positioning the service tool relative to another one of the sand control screen assemblies;

pumping the treatment fluid through the service tool into another one of the production intervals; and terminating the pumping the treatment fluid.

37. The method as recited in claim 36 wherein the step of preventing fluid flow from the interior to the exterior of the sand control screen assemblies further comprises preventing fluid flow from the interior to the exterior of the sand control screen assemblies with a plurality of one-way valves disposed within the sand control screen assemblies.

38. The method as recited in claim 37 further comprising the step of allowing fluid flow from the exterior to the interior of the sand control screen assemblies through the one-way valves.

39. The method as recited in claim 38 wherein the step of preventing fluid flow from the interior to the exterior of the sand control screen assemblies further comprises preventing fluid flow from the interior to the exterior of the sand control screen assemblies with sleeves disposed within the sand control screen assemblies.

40. The method as recited in claim 39 further comprising the step of allowing fluid flow through the sand control screen assemblies by axially shifting the sleeves from first positions to second positions.

41. The method as recited in claim 39 further comprising the step of allowing fluid flow through the sand control screen assemblies by rotatably shifting the sleeves from first positions to second positions.

42. The method as recited in claim 39 further comprising the step of allowing fluid flow through the sand control screen assemblies by removing the sleeves.

43. The method as recited in claim 36 wherein the step of preventing fluid flow from the interior to the exterior of the sand control screen assemblies further comprises preventing fluid flow from the interior to the exterior of the sand control screen assemblies with a plurality of plugs disposed within the sand control screen assemblies.

44. The method as recited in claim 43 further comprising the step of allowing fluid flow between the interior and the exterior of the sand control screen assemblies by mechanically removing the plugs.

45. The method as recited in claim 43 further comprising the step of allowing fluid flow between the interior and the exterior of the sand control screen assemblies by chemically removing the plugs.

46. The method as recited in claim 36 wherein the steps of pumping a treatment fluid further comprise pumping a fracture fluid and fracturing the respective formations.

47. The method as recited in claim 36 wherein the steps of pumping a treatment fluid further comprise pumping a gravel packing fluid and gravel packing the respective production intervals.

48. The method as recited in claim 36 further comprising the step of continuing to prevent fluid flow from the interior to the exterior of the sand control screen assemblies after the steps of terminating the pumping of the treatment fluid.

49. A single trip method for fracturing first and second formations traversed by a wellbore comprising the steps of:

respectively locating first and second sand control screen assemblies within the wellbore proximate the first and second formations;

preventing fluid flow from the interior to the exterior of the sand control screen assemblies;

operably positioning a service tool relative to the first sand control screen assembly;

pumping a fracture fluid into the first formation to fracture the first formation;

terminating the pumping of the fracture fluid;

operably positioning the service tool relative to the second sand control screen assembly;

pumping the fracture fluid into the second formation to fracture the second formation; and terminating the pumping of the fracture fluid.

50. The method as recited in claim 49 wherein the step for preventing fluid flow from the interior to the exterior of the sand control screen assemblies further comprises preventing fluid flow from the interior to the exterior of the sand control screen assemblies with a plurality of one-way valves disposed within the sand control screen assemblies.

51. The method as recited in claim 49 further comprising the step of continuing to prevent fluid flow from the interior to the exterior of the sand control screen assemblies after the steps of terminating the pumping of the fracture fluid.

52. A single trip downhole treatment method comprising the steps of:

respectively locating first and second sand control screen assemblies within first and second production intervals of a wellbore proximate first and second formations;

operably positioning a service tool relative to the first sand control screen assembly;

filling the interior of the first sand control screen assembly with a sand plug;

treating the first production interval;

operably positioning the service tool relative to the second sand control screen assembly;

filling the interior of the second sand control screen assembly with the sand plug; and treating the second production interval.

53. The method as recited in claim 52 wherein steps of treating the first and second production intervals further comprise the steps of pumping a fracture fluid into the first and second formations to fracture the first and second formations.

54. The method as recited in claim 52 further comprising the step of preventing fluid flow from the interior to the exterior of the sand control screen assemblies.

55. The method as recited in claim 52 wherein steps of treating the first and second production intervals further comprise pumping a gravel packing fluid into the first and second production intervals to gravel pack the first and second production intervals.

56. The method as recited in claim 52 wherein the steps of filling the interior of the sand control screen assemblies with the sand plug further comprise pumping a first treatment fluid containing first solid agents into the interior of the sand control screen assemblies and wherein the steps of treating the production intervals further comprise pumping a second treatment into the formations and pumping a third treatment fluid containing second solid agents into the production intervals.

57. The method as recited in claim 56 wherein the steps of pumping a second treatment fluid further comprise pumping a second treatment fluid comprising third solid agents.

58. The method as recited in claim 57 wherein the concentration of the third solid agents in the second treatment fluid is lower than the concentration of first solid agents in the first treatment fluid.

59. The method as recited in claim 57 wherein the concentration of the third solid agents in the second treatment fluid is lower than the concentration of second solid agents in the third treatment fluid.

60. The method as recited in claim 56 further comprising the step of preventing fluid flow from the interior to the exterior of the sand control screen assembly with at least one valve operably associated with a base pipe of the sand control screen assembly that controls fluid flow through openings of the base ripe.

61. The method as recited in claim 56 further comprising the step of preventing fluid flow from the interior to the exterior of the sand control screen assembly with a seal member operably associated with a base pipe of the sand control screen assembly that controls fluid flow through openings of the base pipe.

62. The method as recited in claim 56 wherein the viscosity of the second treatment fluid is higher than the viscosity of the first treatment fluid.

63. The method as recited in claim 56 wherein the viscosity of the second treatment fluid is higher than the viscosity of the third treatment fluid.

64. A single trip downhole treatment method comprising the steps of:

respectively locating the first and second sand control screen assemblies within first and second production intervals of a wellbore proximate first and second formations;

operably positioning a service tool relative the first sand control screen assembly;

pumping a first treatment fluid containing first solid agents through the service tool into the interior of the first sand control screen assembly to place a sand plug therein;

pumping a second treatment fluid through the service tool into the first formation to fracture the first formation;

pumping a third treatment fluid containing second solid agents into the first production interval to pack the first production interval with the second solid agents;

terminating the pumping of the third treatment fluid;

operably positioning the service tool relative to the second sand control screen assembly;

pumping a fourth treatment fluid containing third solid agents through the service tool into the interior of the second sand control screen assembly to place the sand plug therein;

pumping a fifth treatment fluid through the service tool into the second formation to fracture the second formation;

pumping a sixth treatment fluid containing fourth solid agents into the second production interval to pack the second production interval with the fourth solid agents; and terminating the pumping of the sixth treatment fluid.

65. A downhole treatment method comprising the steps of:

locating a sand control screen assembly within a production interval of a wellbore, the sand control screen assembly including a base pipe having a plurality of openings and a filter medium positioned about an exterior of the base pipe;

preventing fluid flow from the interior to the exterior of the sand control screen assembly with at least one valve operably associated with the base pipe that controls fluid flow through the openings of the base pipe; and pumping a treatment fluid into the production interval.

66. The method as recited in claim 65 further comprising the step of allowing fluid flow from the exterior of the base pipe to the interior of the base pipe through the at least one valve.

67. The method as recited in claim 65 wherein the step of pumping a treatment fluid into the production interval further comprises pumping a fracture fluid into the production interval and fracturing a formation.

68. The method as recited in the claim 65 wherein the step of pumping a treatment fluid into the production interval further comprises pumping a gravel packing fluid into the production interval and gravel packing the production interval.

69. The method as recited in claim 65 further comprising the step of continuing to prevent fluid flow from the interior to the exterior of the sand control screen assembly after terminating the pumping of the treatment fluid.

70. A downhole treatment method comprising the steps of:

locating a sand control screen assembly within a production interval of a wellbore;

preventing fluid flow from the interior to the exterior of the sand control screen assembly with a seal member operably associated with a base pipe of the sand control screen assembly that controls fluid flow through openings of the base pipe;

filling the interior of the sand control screen assembly with a sand plug; and treating the production interval.

71. The method as recited in claim 70 wherein the step of treating the production interval further comprises the steps of pumping a fracture fluid into a formation traversed by the wellbore and fracturing the formation.

72. The method as recited in claim 70 wherein the step of treating the production interval further comprises the step of pumping a gravel packing fluid into the production interval and gravel packing the production interval.

73. The method as recited in claim 70 wherein the step of filling the interior of the sand control screen assembly with a sand plug further comprises pumping a first treatment fluid containing first solid agents into the interior of the sand control screen assembly and wherein the step of treating the production interval further comprises the steps of pumping a second treatment fluid into a formation traversed by the wellbore, pumping a third treatment fluid containing second solid agents into the production interval, and terminating the pumping of the third treatment fluid when the production interval is packed with the second solid agents.

74. The method as recited in claim 70 wherein the step of preventing fluid flow from the interior to the exterior of the sand control screen assembly with a seal member further comprise preventing fluid flow from the interior to the exterior of the sand control screen assembly with at least one valve operably associated with the base pipe of the sand control screen assembly that controls fluid flow through the openings of the base pipe.

75. The method as recited in claim 70 wherein the step of preventing fluid flow from the interior to the exterior of the sand control screen assembly with a seal member further comprise preventing fluid flow from the interior to the exterior of the sand control screen assembly with a sleeve operably associated with the base pipe of the sand control screen assembly that controls fluid flow through the openings of the base pipe.

76. The method as recited in claim 70 wherein the step of preventing fluid flow from the interior to the exterior of the sand control screen assembly with a seal member further comprise preventing fluid flow from the interior to the exterior of the sand control screen assembly with removable plugs positioned within the openings of the base pipe.

77. A single trip method for treating multiple formations traversed by a wellbore comprising the steps of:

respectively positioning sand control screen assemblies within production intervals of the wellbore proximate the formations;

preventing fluid flow from the interior to the exterior of the sand control screen assemblies;

operably positioning a service tool relative to one of the sand control screen assemblies;

pumping a treatment fluid through the service tool into one of the production intervals; and repeating the steps of operably positioning the service tool and pumping a treatment fluid for each of the formations to be treated.

78. The method as recited in claim 77 wherein the step of preventing fluid flow from the interior to the exterior of the sand control screen assemblies further comprises operably associating a seal member with each of the sand control screen assemblies.

79. The method as recited in claim 77 wherein the step of preventing fluid flow from the interior to the exterior of the sand control screen assemblies further comprises operably associating at least one valve with each of the sand control screen assemblies.

80. The method as recited in claim 77 wherein the step of preventing fluid flow from the interior to the exterior of the sand control screen assemblies further comprises operably associating a sleeve with each of the sand control screen assemblies.

81. The method as recited in claim 77 wherein the step of preventing fluid flow from the interior to the exterior of the sand control screen assemblies further comprises operably positioning a removable plug within openings of each the sand control screen assemblies.

82. The method as recited in claim 77 wherein the steps of pumping a treatment fluid further comprise filling the interior of the respective sand control screen assemblies with sand plugs.

83. The method as recited in claim 77 wherein the steps of pumping a treatment fluid further comprise pumping a fracture fluid and fracturing the respective formations.

84. The method as recited in claim 77 wherein the steps of pumping a treatment fluid further comprise pumping a gravel packing fluid and gravel packing the respective production intervals.

* * * * *